US010514636B2

(12) United States Patent
Takagi

(10) Patent No.: US 10,514,636 B2
(45) Date of Patent: Dec. 24, 2019

(54) IMAGE HEATING APPARATUS AND IMAGE FORMING APPARATUS THAT CORRECT AN AMOUNT OF CURRENT SUPPLIED TO A PLURALITY OF HEAT GENERATING RESISTORS USING DETECTED TEMPERATURES

(71) Applicant: CANON KABUSHIKI KAISHA, Tokyo (JP)

(72) Inventor: Kenji Takagi, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/050,706

(22) Filed: Jul. 31, 2018

(65) Prior Publication Data

US 2019/0041780 A1 Feb. 7, 2019

(30) Foreign Application Priority Data

Aug. 4, 2017 (JP) ..... 2017-151519

(51) Int. Cl.
*G03G 15/20* (2006.01)
*G03G 15/00* (2006.01)

(52) U.S. Cl.
CPC ..... *G03G 15/2039* (2013.01); *G03G 15/00* (2013.01); *G03G 15/20* (2013.01); *G03G 15/2042* (2013.01); *G03G 15/80* (2013.01); *G03G 2215/2035* (2013.01)

(58) Field of Classification Search
None
See application file for complete search history.

(56) References Cited

U.S. PATENT DOCUMENTS 7,599,637 B2 10/2009 Nanataki et al.
7,865,102 B2 1/2011 Nanataki et al.
2011/0081157 A1* 4/2011 Mitsuoka ..... G03G 15/2039 399/69

FOREIGN PATENT DOCUMENTS

JP H04-044075 A 2/1992
JP 11084936 A * 3/1999
JP 2015129789 A * 7/2015
JP 2015-194713 A 11/2015

OTHER PUBLICATIONS

JP_11084936_A_T MachineTranslation, Japan, 1999.*
JP_2015129789_A_T MachineTranslation, Japan, 2015.*

* cited by examiner

*Primary Examiner* — Victor Verbitsky
(74) *Attorney, Agent, or Firm* — Venable LLP

(57) ABSTRACT

An image heating apparatus includes a heater having a plurality of resistors, and a power supply control circuit that controls power supplied to the plurality of resistors so as to selectively heat a plurality of heating regions. A plurality of thermistors detect a temperature of each of a plurality of regions of the image heater, and a processor functions as a current amount correcting portion that corrects an amount of current supplied to the plurality of resistors. The current amount is corrected based on the temperature detected by each of the plurality of thermistors, so that a difference of a temperature rising amount per unit time among the plurality of heating regions at the start of an image heating operation becomes small and a total amount of power supplied to the plurality of heat generating elements is kept to within a predetermined limited power amount.

16 Claims, 17 Drawing Sheets

FIG.6

| P | θ p | Ton msec | |
|---|---|---|---|
| % | deg | 50Hs | 60Hs |
| 100.0% | 0.00 | 0.00 | 0.00 |
| 99.0% | 20.88 | 1.16 | 0.97 |
| 98.0% | 26.45 | 1.47 | 1.22 |
| 97.0% | 30.41 | 1.69 | 1.41 |
| 96.0% | 33.62 | 1.87 | 1.56 |
| 95.0% | 36.35 | 2.02 | 1.68 |
| 94.0% | 38.77 | 2.15 | 1.80 |
| 93.0% | 40.96 | 2.28 | 1.90 |
| 92.0% | 42.98 | 2.39 | 1.99 |
| 91.0% | 44.85 | 2.49 | 2.08 |
| 90.0% | 46.60 | 2.59 | 2.16 |
| 89.0% | 48.26 | 2.68 | 2.23 |
| 88.0% | 49.84 | 2.77 | 2.31 |
| 87.0% | 51.35 | 2.85 | 2.38 |
| 86.0% | 52.79 | 2.93 | 2.44 |
| 85.0% | 54.19 | 3.01 | 2.51 |
| 84.0% | 55.53 | 3.09 | 2.57 |
| 83.0% | 56.84 | 3.16 | 2.63 |
| 82.0% | 58.10 | 3.23 | 2.69 |
| 81.0% | 59.34 | 3.30 | 2.75 |
| 80.0% | 60.54 | 3.36 | 2.80 |
| 79.0% | 61.71 | 3.43 | 2.86 |
| 78.0% | 62.86 | 3.49 | 2.91 |
| 77.0% | 63.98 | 3.55 | 2.96 |
| 76.0% | 65.09 | 3.62 | 3.01 |
| 75.0% | 66.17 | 3.68 | 3.06 |
| 74.0% | 67.24 | 3.74 | 3.11 |
| 73.0% | 68.29 | 3.79 | 3.16 |
| 72.0% | 69.33 | 3.85 | 3.21 |
| 71.0% | 70.35 | 3.91 | 3.26 |
| 70.0% | 71.36 | 3.96 | 3.30 |
| 69.0% | 72.35 | 4.02 | 3.35 |
| 68.0% | 73.34 | 4.07 | 3.40 |
| 67.0% | 74.31 | 4.13 | 3.44 |
| 66.0% | 75.28 | 4.18 | 3.49 |
| 65.0% | 76.24 | 4.24 | 3.53 |
| 64.0% | 77.19 | 4.29 | 3.57 |
| 63.0% | 78.13 | 4.34 | 3.62 |
| 62.0% | 79.07 | 4.39 | 3.66 |
| 61.0% | 80.00 | 4.44 | 3.70 |
| 60.0% | 80.92 | 4.50 | 3.75 |
| 59.0% | 81.85 | 4.55 | 3.79 |
| 58.0% | 82.76 | 4.60 | 3.83 |
| 57.0% | 83.67 | 4.65 | 3.87 |
| 56.0% | 84.58 | 4.70 | 3.92 |
| 55.0% | 85.49 | 4.75 | 3.96 |
| 54.0% | 86.40 | 4.80 | 4.00 |
| 53.0% | 87.30 | 4.85 | 4.04 |
| 52.0% | 88.20 | 4.90 | 4.08 |
| 51.0% | 89.10 | 4.95 | 4.12 |
| 50.0% | 90.00 | 5.00 | 4.17 |

| P | θ p | Ton msec | |
|---|---|---|---|
| % | deg | 50Hs | 60Hs |
| 49.0% | 90.90 | 5.05 | 4.21 |
| 48.0% | 91.80 | 5.10 | 4.25 |
| 47.0% | 92.70 | 5.15 | 4.29 |
| 46.0% | 93.60 | 5.20 | 4.33 |
| 45.0% | 94.51 | 5.25 | 4.38 |
| 44.0% | 95.42 | 5.30 | 4.42 |
| 43.0% | 96.33 | 5.35 | 4.46 |
| 42.0% | 97.24 | 5.40 | 4.50 |
| 41.0% | 98.15 | 5.45 | 4.54 |
| 40.0% | 99.08 | 5.50 | 4.59 |
| 39.0% | 100.00 | 5.56 | 4.63 |
| 38.0% | 100.93 | 5.61 | 4.67 |
| 37.0% | 101.87 | 5.66 | 4.72 |
| 36.0% | 102.81 | 5.71 | 4.76 |
| 35.0% | 103.76 | 5.76 | 4.80 |
| 34.0% | 104.72 | 5.82 | 4.85 |
| 33.0% | 105.69 | 5.87 | 4.89 |
| 32.0% | 106.66 | 5.93 | 4.94 |
| 31.0% | 107.65 | 5.98 | 4.98 |
| 30.0% | 108.64 | 6.04 | 5.03 |
| 29.0% | 109.65 | 6.09 | 5.08 |
| 28.0% | 110.67 | 6.15 | 5.12 |
| 27.0% | 111.71 | 6.21 | 5.17 |
| 26.0% | 112.76 | 6.26 | 5.22 |
| 25.0% | 113.83 | 6.32 | 5.27 |
| 24.0% | 114.91 | 6.38 | 5.32 |
| 23.0% | 116.02 | 6.45 | 5.37 |
| 22.0% | 117.14 | 6.51 | 5.42 |
| 21.0% | 118.29 | 6.57 | 5.48 |
| 20.0% | 119.46 | 6.64 | 5.53 |
| 19.0% | 120.66 | 6.70 | 5.59 |
| 18.0% | 121.90 | 6.77 | 5.64 |
| 17.0% | 123.16 | 6.84 | 5.70 |
| 16.0% | 124.47 | 6.91 | 5.76 |
| 15.0% | 125.81 | 6.99 | 5.82 |
| 14.0% | 127.21 | 7.07 | 5.89 |
| 13.0% | 128.65 | 7.15 | 5.96 |
| 12.0% | 130.16 | 7.23 | 6.03 |
| 11.0% | 131.74 | 7.32 | 6.10 |
| 10.0% | 133.40 | 7.41 | 6.18 |
| 9.0% | 135.15 | 7.51 | 6.26 |
| 8.0% | 137.02 | 7.61 | 6.34 |
| 7.0% | 139.04 | 7.72 | 6.44 |
| 6.0% | 141.23 | 7.85 | 6.54 |
| 5.0% | 143.65 | 7.98 | 6.65 |
| 4.0% | 146.38 | 8.13 | 6.78 |
| 3.0% | 149.59 | 8.31 | 6.93 |
| 2.0% | 153.55 | 8.53 | 7.11 |
| 1.0% | 159.12 | 8.84 | 7.37 |
| 0.0% | 180.00 | 10.00 | 8.33 |

FIG.9

| $\Delta T_{TH1}$、$\Delta T_{TH2}$、$\Delta T_{TH3}$ | CORRECTION COEFFICIENT E |
|---|---|
| >-20℃ | 12% |
| -18℃ | 11% |
| -16℃ | 10% |
| -14℃ | 8% |
| -12℃ | 7% |
| -10℃ | 6% |
| -8℃ | 5% |
| -6℃ | 4% |
| -4℃ | 2% |
| -2℃ | 1% |
| ±0℃ | 0% |
| +2℃ | -1% |
| +4℃ | -2% |
| +6℃ | -4% |
| +8℃ | -5% |
| +10℃ | -6% |
| +12℃ | -7% |
| +14℃ | -8% |
| +16℃ | -10% |
| +18℃ | -11% |
| <+20℃ | -12% |

IMAGE HEATING APPARATUS AND IMAGE FORMING APPARATUS THAT CORRECT AN AMOUNT OF CURRENT SUPPLIED TO A PLURALITY OF HEAT GENERATING RESISTORS USING DETECTED TEMPERATURES

This application claims the benefit of Japanese Patent Application No. 2017-151519, filed on Aug. 4, 2017, which is hereby incorporated by reference herein in its entirety.

BACKGROUND OF THE INVENTION

Field of the Invention

The present invention relates to an image heating apparatus, such as a fixing unit installed in an image forming apparatus (e.g. copier, printer), which uses an electrophotographic system or an electrostatic recording system, or a gloss applying apparatus that improves the gloss value of a toner image by reheating a fixed toner image on a recording material. The present invention also relates to an image forming apparatus equipped with this image heating apparatus.

Description of the Related Art

As an image heating apparatus installed in such an image forming apparatus, such as a copier and a laser beam printer, a film heating type image heating apparatus, which excels in on demand use, has been widely used (Japanese Patent Application Publication No. H04-44075). The film heating type image heating apparatus is constituted by a ceramic heater in which a heat generating resistor is disposed as a heating source, a heat resistant film as a fixing member, and a roller-shaped pressure member (hereafter "pressure roller"). The heater and the pressure roller constitute a nip unit (hereafter "fixing nip") sandwiching the film, and this fixing nip holds and conveys a recording material so that the unfixed toner image on the recording material is heated and fixed during this process. If a small sized paper is continuously printed using the image forming apparatus that includes this image heating apparatus, a temperature in a region in which the recording material does not pass in the longitudinal direction of the fixing nip unit gradually increases (temperature rising in the non-paper passing portion). If the temperature in the non-paper passing portion increases too much, each component inside the apparatus is more easily damaged. Further, if a large sized paper is printed in the state of temperature rising in the non-paper passing portion, a high temperature offset is generated in a region that corresponds to the non-paper passing portion in the case of printing the small sized paper. In Japanese Patent Application Publication No. 2015-194713, in order to reduce this temperature rising in the non-paper passing region, a heat generating resistor on a heater substrate is divided in the longitudinal direction, and the power supply to each heating block, which includes each divided heat generating resistor, is independently controlled. By this configuration, a plurality of heating regions of the paper passing portion can be selectively heated in accordance with the width of the recording material to be fed, whereby the temperature rising in the non-paper passing portion can be controlled.

In the configuration of Japanese Patent Application Publication No. 2015-194713, however, if the temperature rising speed of each heating region varies when the image heating apparatus is heated up to a predetermined temperature when the print operation is started (when the fixing start up control is performed), a desired temperature distribution in the longitudinal direction may not be generated by a predetermined timing when the recording material is fed. The temperature rising speed of each heating region varies when, for example, a resistance value or a temperature resistance characteristic, such as a Temperature Coefficient of Resistance (TCR), of each heat generating resistor varies, the thermal capacity of each member varies, or a fixing nip width varies. If a recording material is passed in a state in which a desired temperature distribution in the longitudinal direction is not generated, an image failure, such as a fixing failure in low temperature areas, may be generated. Further, if feeding the recording material to the image heating apparatus is delayed until a desired temperature distribution in the longitudinal direction is generated, a first print out time (FPOT) may be delayed.

SUMMARY OF THE INVENTION

It is an object of the present invention to provide a technique to decrease the FPOT and to acquire a good output image by suppressing the variation of the temperature rising in each heating region of the image heating apparatus when the fixing start up control is performed.

In one aspect, the present invention provides an image heating apparatus that includes an image heating portion that includes a heater constituted of a substrate and a plurality of heat generating elements disposed on the substrate in a longitudinal direction of the substrate, and that is configured to heat an image formed on a recording material by using the heat of the heater, a power supply control portion configured to control power to be supplied to the plurality of heat generating elements so as to selectively heat a plurality of heating regions corresponding to the plurality of heat generating elements, respectively, a plurality of temperature detecting portions configured to detect temperature of each of the plurality of heating regions, and a current amount correcting portion configured to correct an amount of current that the power supply control portion supplies to the plurality of heat generating elements, wherein the current amount correcting portion corrects the current amount, based on the temperature detected by each of the plurality of temperature detecting portions, so that a difference of a temperature rising amount per unit time among the plurality of heating regions at the start of an image heating operation becomes small.

In another aspect, the present invention provides an image forming apparatus that includes an image forming unit configured to form an image on a recording material and a fixing portion configured to fix an image, formed on a recording material, onto the recording material, wherein the fixing portion is the image heating apparatus of the present invention.

According to the present invention, the FPOT can be decreased and a good output image can be acquired by suppressing the variation of the temperature rising in each heating region of the image heating apparatus when the fixing start up control is performed.

Further features of the present invention will become apparent from the following description of exemplary embodiments with reference to the attached drawings.

BRIEF DESCRIPTION OF THE DRAWINGS

FIG. 6 is a table showing the relationship of the timing of the heater drive signal and the power supplied to the heater.

FIG. 9 is a temperature difference current correction table.

DESCRIPTION OF THE EMBODIMENTS

Hereafter, a description will be given, with reference to the drawings, of embodiments (examples) of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Example 1

Figure 1:
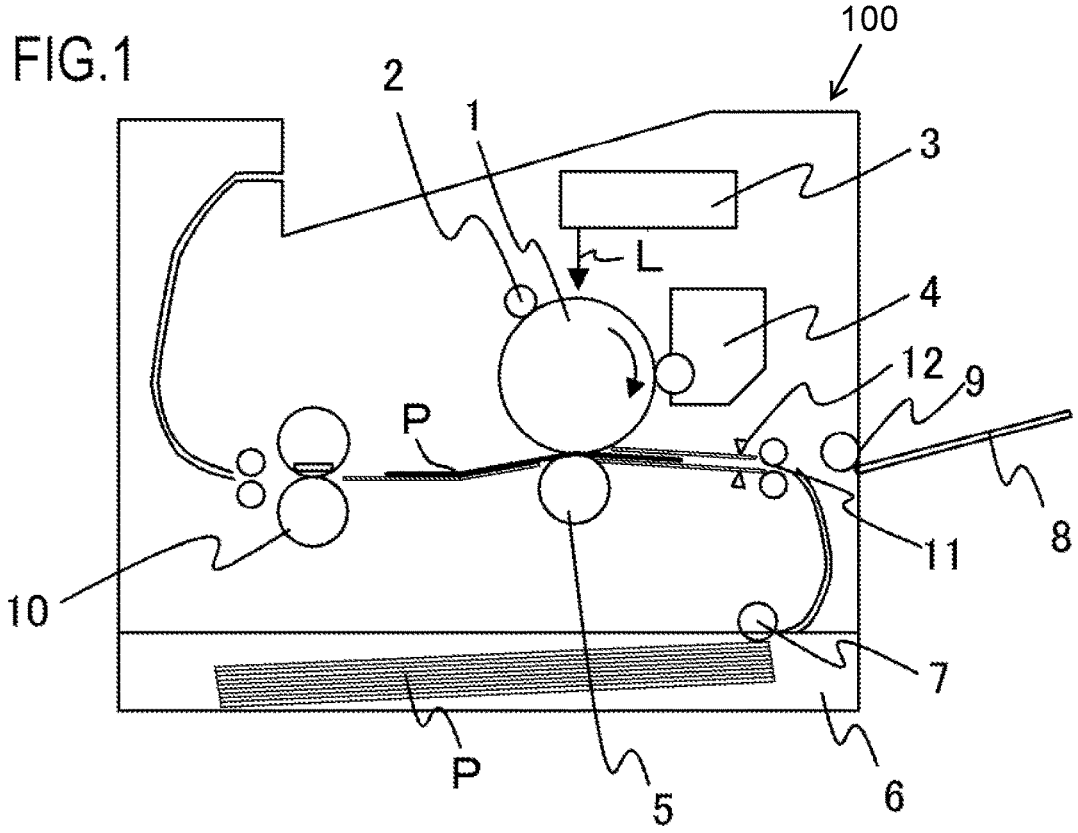
FIG. 1 is a cross-sectional view depicting an image forming apparatus according to an example of the present invention.

FIG. 1 is a schematic cross-sectional view depicting a general configuration of a laser beam printer (hereafter "laser printer") 100, which is an image forming apparatus according to an example of the present invention. A photosensitive drum 1 is rotationally driven in the arrow direction, and the surface of the photosensitive drum 1 is uniformly charged by a charging roller 2, which is a charging apparatus. A laser scanner 3 scans and exposes the surface of the photosensitive drum 1 using a laser beam L, of which ON/OFF is controlled in accordance with the image information, so as to form an electrostatic latent image (latent image forming process). A developing apparatus 4 allows toner to adhere to this electrostatic latent image, and develops the toner image onto the photosensitive drum 1 (developing process). In a transfer nip portion in which a transfer roller 5 and the photosensitive drum 1 are pressure-contacted, the toner image formed on the photosensitive drum 1 is transferred to a recording material P, which is a heating material conveyed from a paper feed cassette 6 at a predetermined timing by a paper feed roller 7 (transfer process). At this time, a top sensor 12 detects the front edge of the recording material, which is conveyed by a conveying roller 11 to match the timing, so that the image forming position of the toner image on the photosensitive drum 1 matches with the writing start position at the front edge of the recording material P. The recording material P, which is conveyed to the transfer nip portion at a predetermined timing, is held and conveyed by the photosensitive drum 1 and the transfer roller 5 at a predetermined pressure. The above mentioned configuration related to the steps up to forming the unfixed image on the recording material P corresponds to an image forming portion according to the present invention. The recording material P, on which the unfixed toner image was transferred, is conveyed to a fixing apparatus 10 (image heating apparatus), which is a fixing portion (image heating portion), and is heated and fixed on the recording material by the fixing apparatus 10 using heat and pressure. Then, the recording material P is ejected onto a paper delivery tray.

The laser printer 100 of Example 1 supports a plurality of recording material sizes. In the paper feed cassette 6, letter size paper (about 216 mm×279 mm), legal size paper (about 216 mm×356 mm), A4 size paper (210 mm×297 mm), and executive size paper (about 184 mm×267 mm) can be set. Further, B5 size paper (182 mm×257 mm) and A5 size paper (148 mm×210 mm) can also be set.

Furthermore, a dimension lengthwise (DL) envelope (110 mm×220 mm), a COM 10 envelope (about 105 mm×241 mm), or a non-standard paper can be fed from a paper feed tray 8 by an MP paper feed roller 9 and printed. The laser printer 100 of Example 1 is basically a laser printer 100 that feeds paper longitudinally (longer side of the paper is moved parallel with the conveying direction). A recording paper having the longest width, out of the widths of the standard recording materials (width of each recording material listed in catalogs) supported by the apparatus, is letter size paper and legal size paper, and the width thereof is about 216 mm. A recording material P, of which a paper width is shorter than the maximum size supported by the apparatus, is defined as "small size paper" in Example 1.

Figure 2:
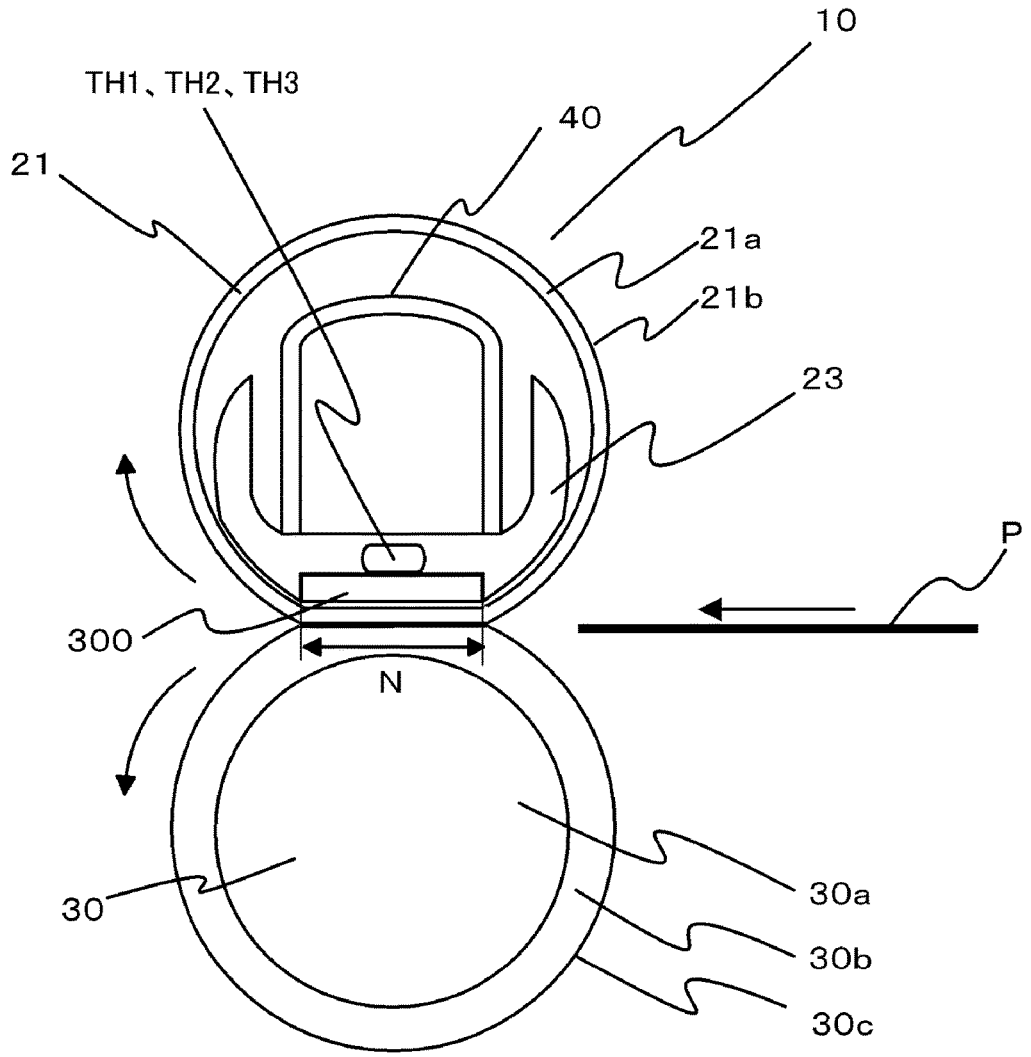
FIG. 2 is a cross-sectional view depicting a fixing apparatus according to Example 1.

The fixing apparatus 10 according to Example 1 will be described with reference to FIG. 2. FIG. 2 is a schematic cross-sectional view of the fixing apparatus 10. The fixing apparatus includes a cylindrical film 21, which is an endless belt, a heater 300 that contacts the inner surface of the film 21, and a pressure roller 30 that is a pressure rotating member forming a fixing nip portion N with the heater 300 via the film 21.

The film 21 has a base layer 21*a* and a release layer 21*b* that is formed outside the base layer. The base layer 21*a* is formed of a heat resistant resin (e.g. polyimide, polyamide imide, polyether ether ketone (PEEK)), or a metal (e.g. stainless use steel (SUS)). In Example 1, a 65 μm thick heat resistant resin (polyimide) is used. The release layer 21*b* is formed by coating a single or mixture of heat resistant resin(s) having good releasability, such as fluorine resin (e.g. polytetrafluoroethylene (PTFE), perfluoroalkoxy alkane (PFA), fluorinated ethylene propylene (FEP)) or silicone resin. In Example 1, a 15 μm thick fluorine resin (PFA) is coated as the release layer 21*b*. The length of the film 21 in the longitudinal direction is 240 mm in Example 1, and the outer diameter thereof is 24 mm.

A heater support member 23 is a guide member for the film 21 to rotate, and the film 21 is loosely fitted outside the heater support member 23. The heater support member 23 also supports the heater 300. The heater support member 23 is made of a heat resistant resin, such as liquid crystal polymer, phenol resin, polyphenylene sulfide (PPS), and PEEK.

The pressure roller 30, which is a pressure member, includes a metal core 30*a*, an elastic layer 30*b* formed outside the metal core 30*a*, and a release layer 30*c*. The metal core 30*a* is made of metal, such as SUS, stainless use metal (SUM), and Aluminum (Al). The elastic layer 30*b* is made of a heat resistant rubber (e.g. silicone rubber, fluorine rubber) or a foamed silicone rubber. The release layer 30*c* is on the outer side of the elastic layer 30*b*, and is 50 μm thick fluorine resin (PFA). The outer diameter of the pressure roller 30 of Example 1 is 25 mm, and the elastic layer 30*b* is made of a silicone rubber of which thickness is 3.5 mm. In the pressure roller 30, the length of the elastic layer 30*b* in the longitudinal direction is 230 mm.

A stay 40 is a member to apply pressure of a spring (not illustrated) to the heater support member 23 in the pressure roller 30 direction, so as to form the fixing nip portion N, which heats and fixes the toner on the recording material P, and is made of a metal having high rigidity.

The pressure roller 30 rotates by the drive force from a drive source (not illustrated), which is transferred to a gear (not illustrated) disposed on an edge of the metal core 30*a* in the longitudinal direction. The film 21 is rotated with the pressure roller 30 by a frictional force received from the pressure roller 30 in the fixing nip portion N.

Thermistors TH1 to TH3, which are temperature detecting elements constituting a temperature detecting portion to detect the temperature of the heater 300, contact the back surface of the heater 300 (opposite surface of the surface contacting the film 21). A safety protective element 212 (FIG. 4) also contacts the back surface of the heater 300 in the same manner. The safety protective element 212 is, for example, a thermo switch, a temperature fuse, or the like, and is activated when the heater 300 overheats to interrupt supplying power to the heater 300.

Figure 3A:
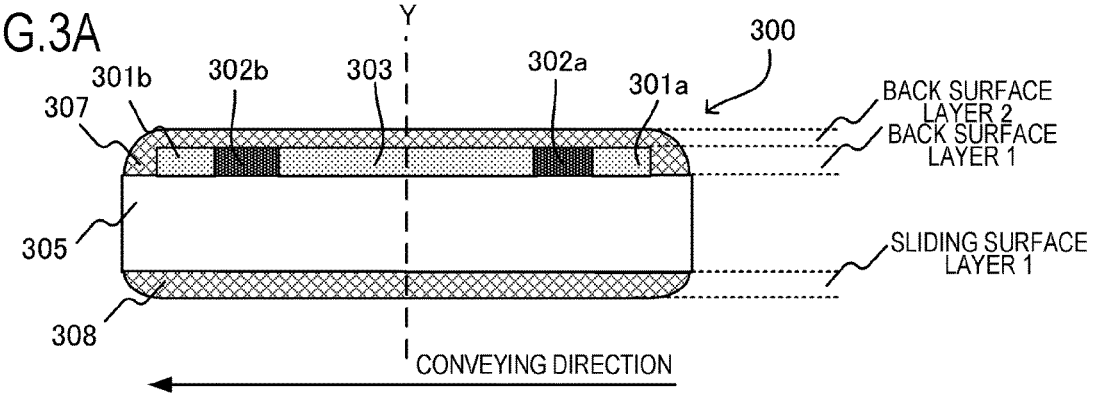
FIGS. 3A and 3B show diagrams depicting a configuration of a heater and a heater support member.
Figure 3B:
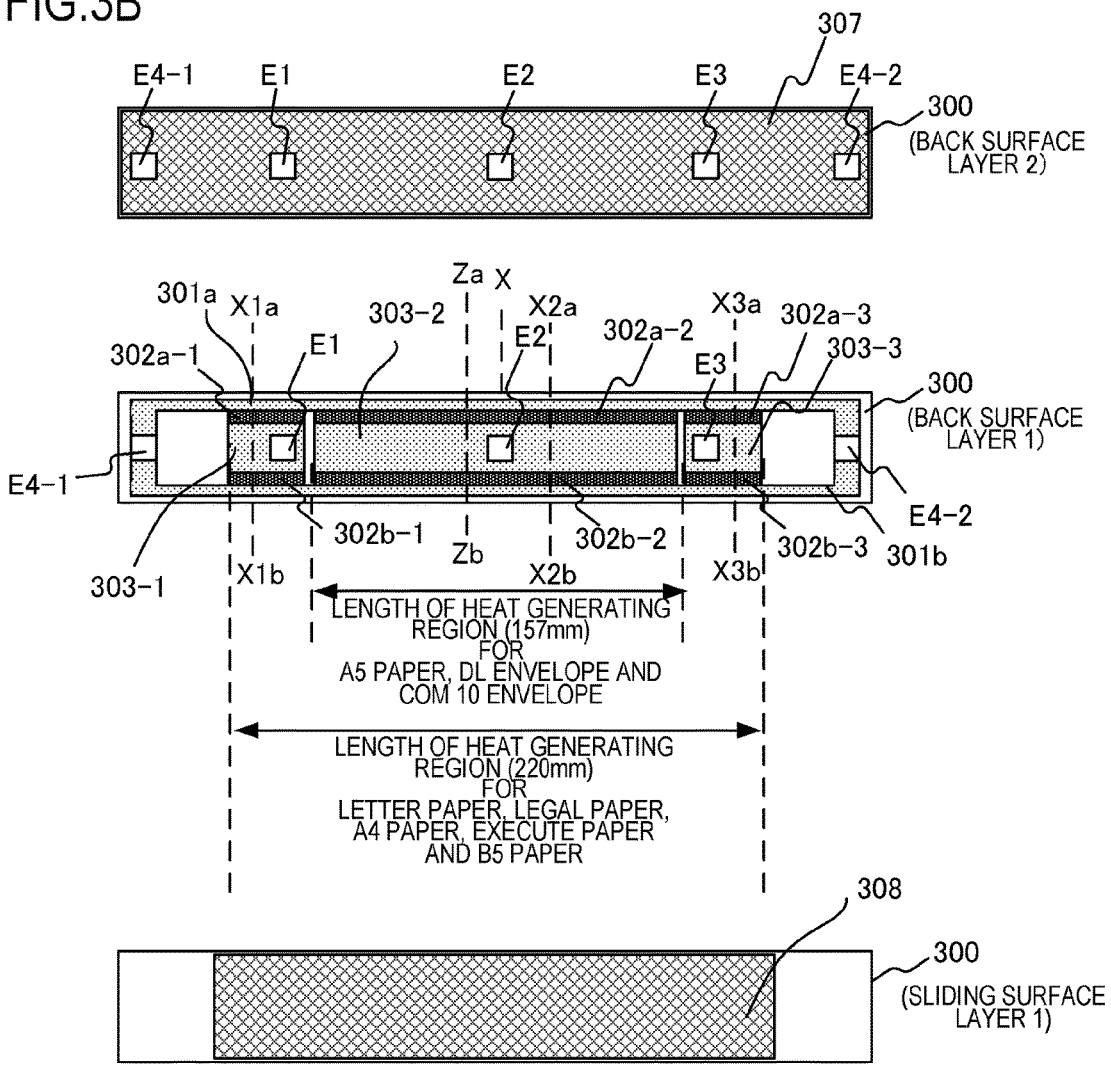

FIG. 3A and FIG. 3B are diagrams depicting the configuration of the heater 300 of Example 1. FIG. 3A is a cross-sectional view of the heater 300 in the lateral direction (direction intersecting orthogonally with the longitudinal direction), and is a cross-sectional view of the Za-Zb plane in FIG. 3B. On the back surface layer 1 of the heater 300, a first conductor 301 is disposed on a substrate 305 (base material of the heater 300) along the longitudinal direction of the heater 300. On the substrate 305, a second conductor 303 is also disposed along the longitudinal direction of the heater 300, at a position that is different from the first conductor 301 in the lateral direction of the heater 300. The first conductor 301 is divided into a conductor 301*a* that is disposed on the upstream side in the direction of conveying the recording material P, and a conductor 301*b* that is disposed on the downstream side. A heat generating resistor (heat generating element) 302 is disposed between the first conductor 301 and the second conductor 303, and is heated by power that is supplied via the first conductor 301 and the second conductor 303. The heat generating resistor 302 is divided into a heat generating resistor 302*a* that is disposed on the upstream side in the direction of conveying the recording material P, and a heat generating resistor 302*b* that is disposed on the downstream side.

If the heating distribution of the heater 300 in the lateral direction (direction of conveying the recording material) becomes asymmetric, the stress generated on the substrate 305, when the heater 300 heats up, increases. If the stress generated on the substrate 305 is high, the substrate 305 may be cracked. Therefore, the heat generating resistor 302 is divided into the heat generating resistor 302*a* disposed on the upstream side of the conveying direction, and the heat generating resistor 302*b* disposed on the downstream side, so that the heating distribution of the heater 300 in the lateral direction becomes symmetric with respect to the center Y in the lateral direction. Here the temperature coefficient of resistance (TCR) value of the heat generating resistor 302 is 1350 PPM. If a positive TCR value (PTC) is set, the resistance of the heat generating element becomes high when the temperature of the heater 300 is high, and the temperature rises gently, hence the thermistors TH1 to TH3 can more easily detect an abnormality of the fixing apparatus 10.

Further, on the back surface layer 2 of the heater 300, an insulating surface protective layer 307 (glass in Example 1) is disposed so as to cover the heat generating resistor 302, the conductor 301, and the conductor 303. A sliding surface (surface contacting the film 21) layer 1 of the heater 300 is coated by a surface protective layer 308 made of a glass or polyimide having slidability.

FIG. 3B shows a plan view of each layer of the heater 300. The heater 300 has a plurality of heating blocks, each of which is constituted by a set of the first conductor 301, the second conductor 303, and the heat generating resistor 302 on the back surface layer 1 in the longitudinal direction of the heater 300. By the plurality of heating blocks, a plurality of heating regions, which are divided in the longitudinal direction in the fixing nip portion N, are heated. For example, the heater 300 of Example 1 has a total of three heating blocks, which are located at the center and at both ends of the heater 300 in the longitudinal direction. The first heating block 302-1 is constituted of the heat generating resistors 302*a*-1 and 302*b*-1, which are formed to be symmetric with respect to the lateral direction of the heater 300. In the same manner, the second heating block 302-2 is constituted of the heat generating resistors 302*a*-2 and 302*b*-2, and the third heating block 302-3 is constituted by the heat generating resistors 302*a*-3 and 302*b*-3.

The first conductor 301 is disposed along the longitudinal direction of the heater 300. The first conductor 301 is constituted of a conductor 301*a* that is connected to the heat generating resistors (302*a*-1, 302*a*-2, 302*a*-3), and a conductor 301*b* that is connected to the heat generating resistors (302*b*-1, 302*b*-2, 302*b*-3). The second conductor 303 disposed along the longitudinal direction of the heater 300 is divided into three conductors 303-1, 303-2 and 303-3. The material used for the first conductor 301 and the second conductor 303 is silver (Ag), and for the heat generating resistor 302, a heat generating resistor having the positive temperature resistance characteristic (PTC characteristic) constituted of a conductive agent (major component is ruthenium oxide (RuO2)), glass, and the like, is used. Here the width (in the longitudinal direction) of the heat generating resistor 302*a*-2 or 302*b*-2, located at the center of the second heating block in the longitudinal direction, is 157 mm. The width (in the longitudinal direction) of the heat generating resistor 302*a*-1 or 302*b*-1 constituting the first heating block is 31.5 mm, and the width (in the longitudinal direction) of the heat generating resistor 302*a*-3 or 302*b*-3 constituting the third heating block is 31.5 mm.

The electrodes E1, E2, D3, E4-1 and E4-2 are connected with electrical contacts to supply power from a later mentioned control circuit 400 of the heater 300. The electrode E1 is an electrode to supply power to the heating block 302-1 (heat generating resistors 302*a*-1, 302*b*-1) via the conductor 303-1. In the same manner, the electrode E2 is an electrode to supply power to the heating block 302-2 (heat generating resistors 302*a*-2, 302*b*-2) via the conductor 303-2. The electrode E3 is an electrode to supply power to the heating block 302-3 (heat generating resistors 302*a*-3, 302*b*-3) via the conductor 303-3. The electrodes E4-1 and E4-2 are common electrodes to supply power to the three heating blocks 302-1 to 303-3 via the conductors 301*a* and the conductor 301*b*.

A resistance value of a conductor is not zero, and, therefore, the heating distribution of the heater 300 in the longitudinal direction is influenced by the resistance of the conductor. Hence, the electrodes E4-1 and E4-2 are disposed on both ends of the heater 300 in the longitudinal direction, so that symmetric heating distribution, with respect to the longitudinal direction of the heater 300, is acquired, even if the heating distribution is influenced by the electrical resistance of the conductors 303-1, 303-2, 303-3, 301*a* and 301*b*.

The surface protective layer 307 of the back surface layer 2 of the heater 300 is formed excluding the sections of the electrodes E1, E2, E3, E4-1 and E4-2, so that an electrical contact can be connected with each electrode from the back surface side of the heater 300. In Example 1, the electrodes E1, E2, E3, E4-1 and E4-2 are disposed on the back surface of the heater 300, so that power can be supplied from the back surface side of the heater 300. Further, the ratio of the current that is supplied to at least one of the plurality of heating blocks, and the current that is supplied to the other heating blocks, can be changed, as mentioned later. The electrodes E1, E2 and E3 are disposed in each region where the heat generating resistor is disposed in the longitudinal direction of the substrate. The surface protective layer 308 of the sliding surface layer 1 of the heater 300 is disposed in a region on which the film 21 slides.

In the heater support member 23, holes (not illustrated) are opened for the electrical contacts of the thermistors TH1 to TH3 and electrodes E1 to E4-2, so as to be connected to a later mentioned control circuit 400, which is a power control unit of the heater 300, via a cable and conductive material (e.g. thin metal plate). The temperature of each heating block is controlled by controlling current such that the thermistors TH1 to TH3, which are temperature detecting units disposed on the rear surface side of the heater, are maintained at a predetermined temperature. Here, the thermistor TH1 is disposed at a center position of the substrate in the lateral direction, and at a position 100 mm distant from the conveyance reference position X of the recording material P toward E4-1 in the longitudinal direction of the substrate (X1*a*-X1*b*), and detects the temperature of the first heating block. The thermistor TH2 is disposed at a center position of the substrate in the lateral direction, and at a position 30 mm distant from the conveyance reference position X of the recording material P toward E4-2 in the longitudinal direction of the substrate (X2*a*-X2*b*), and detects the temperature of the second heating block. The thermistor TH3 is disposed at a center position of the substrate in the lateral direction, and at a position 100 mm distant from the conveyance reference position X of the recording material P toward E4-2 in the longitudinal direction of the substrate (X3*a*-X3*b*), and detects the temperature of the third heating block.

Figure 4:
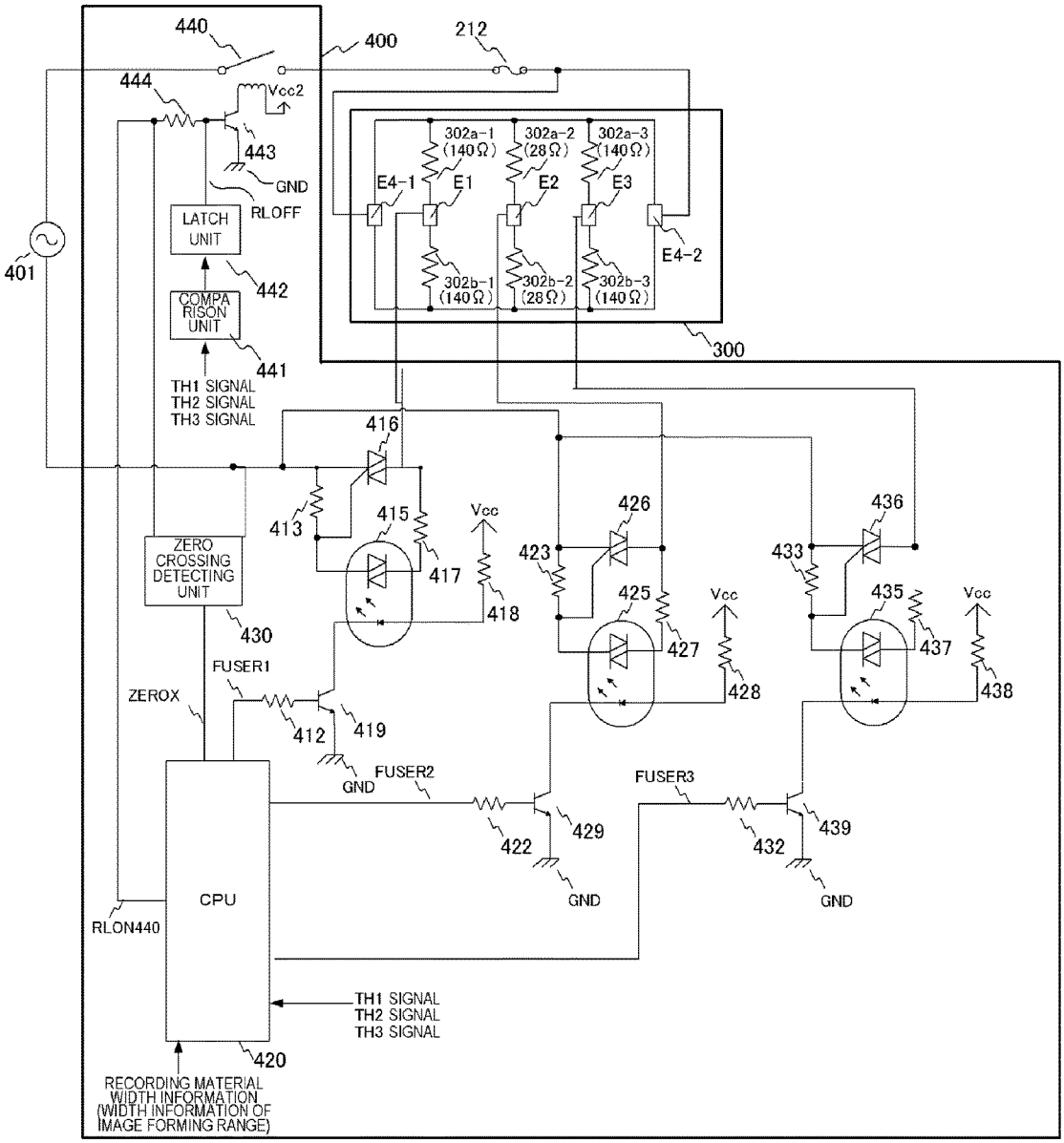
FIG. 4 is a circuit diagram of a heater control circuit.

The power control to the heater 300 will be described with reference to FIG. 4. FIG. 4 is a circuit diagram of the control circuit 400, which is a power control portion of the heater 300 of Example 1. The reference number 401 denotes a commercial alternating current (AC) power supply that is connected to the laser printer 100. The power control to the heater 300 is performed by turning a triac 416, triac 426 and triac 436 ON/OFF. By controlling the triacs 416, 426 and 436, the heat generating resistors 302*a*-1 and 302*b*-1, the heat generating resistors 302*a*-2 and 302*b*-2, and the heat generating resistors 302*a*-3 and 302*b*-3 can be independently controlled. The power is supplied to the heater 300 via the electrodes E1 to E3, E4-1 and E4-2.

A zero crossing detecting unit 430 is a circuit that detects a zero crossing at which the negative/positive AC voltage of an AC power supply 401 is switched, and outputs a ZEROX signal to a central processing unit (CPU) 420. The ZEROX signal is used for controlling the heater 300. A relay 440 is used as a power interrupting unit to interrupt the power supply to the heater 300, and is activated by the output from the thermistors TH1 to TH3 (interrupts the power supply to the heater 300) when the heater 300 overheats due to a failure, or the like.

When an RLON440 signal becomes High, a transistor 443 turns ON, power is supplied from the power supply voltage Vcc2 to a secondary side coil of the relay 440, and a primary side contact of the relay 440 turns ON. When the RLON440 signal becomes Low, the transistor 443 turns OFF, the power supplied from the power supply voltage Vcc2 to the secondary side coil of the relay 440 is interrupted, and the primary side contact of the relay 440 turns OFF. A resistor 444 is a resistor to limit the base current of the transistor 443.

An operation of the safety circuit using the relay 440 will be described. If the detection temperature of one of the thermistors TH1 to TH3 exceeds a respective predetermined value that is set, a comparison unit 441 activates a latch unit 442, and the latch unit 442 latches an RLOFF signal in the Low state. When the RLOFF signal becomes the Low state, the transistor 443 is maintained in the OFF state even if the CPU 420 sets the RLON440 signal to the High state, therefore the relay 440 is maintained in the OFF state (safe state).

If the detection temperature detected by each of the thermistors TH1 to TH3 does not exceed the respective predetermined value that is set, the RLOFF signal of the latch unit 442 becomes an open state. Therefore, if the CPU 420 sets the RLON440 signal to the High state, the relay 440 can be turned ON, and, in this state, power can be supplied to the heater 300.

An operation of the triac 416 will be described. The resistors 413 and 417 are bias resistors for the triac 416, and a photo triac coupler 415 is a device to ensure a creepage distance between a primary and a secondary side. The triac 416 is turned ON by the power supply to a light emitting diode of the photo triac coupler 415. A resistor 418 is a resistor to limit power that is supplied from the power supply voltage Vcc to the light emitting diode of the photo triac coupler 415, and a resistor 412 is a resistor to limit the base current of a transistor 419. The photo triac coupler 415 is turned ON/OFF by the transistor 419. The transistor 419 operates in accordance with a FUSER1 signal from the CPU 420. When the triac 416 is turned ON, power is supplied to the heat generating resistors 302*a*-1 and 302*b*-1 of the first heating block. The resistance values of the heat generating resistors 302*a*-1 and 302*b*-1 are 140Ω, respectively, and the composite resistance value of the heat generating resistors 302*a*-1 and 302*b*-1 of the first heating block is 70Ω.

The circuit operations of the triac 426 and the triac 436 are the same as the triac 416. In other words, bias resistors 423 and 427 and a photo triac coupler 425 are connected to the triac 426, and a transistor 429 turns the photo triac coupler 425 ON/OFF in accordance with a FUSER2 signal from the CPU 420, whereby the triac 426 operates. A resistor 428 is a resistor to limit the power that is supplied from the power supply voltage Vcc to a light emitting diode of the photo triac coupler 425, and a resistor 422 is a resistor to limit the base current of the transistor 429. In the same manner, bias resistors 433 and 437, and a photo triac coupler 435 are connected to the triac 436, and a transistor 439 turns the photo triac coupler 435 ON/OFF in accordance with a FUSER3 signal from the CPU 420, whereby the triac 436 operates. A resistor 438 is a resistor to limit the power that is supplied from the power supply voltage Vcc to a light emitting diode of the photo triac coupler 435, and a resistor 432 is a resistor to limit the base current of the transistor 439.

When the triac 426 turns ON, power is supplied to the heat generating resistors 302*a*-2 and 302*b*-2 of the second heating block. The resistance values of the heat generating resistors 302*a*-2 and 302*b*-2 are 28Ω, respectively, and the composite resistance value of the heat generating resistors 302*a*-2 and 302*b*-2 of the second heating block is 14Ω.

When the triac 436 turns ON, power is supplied to the heat generating resistors 302*a*-3 and 302*b*-3 of the third heating block. The resistance values of the heat generating resistors 302*a*-3 and 302*b*-3 are 140Ω, respectively, and the composite resistance value of the heat generating resistors 302*a*-3 and 302*b*-3 of the third heating block is 70Ω.

A method of controlling the current to be supplied to the heater 300 according to Example 1 will be described. The zero crossing detecting unit 430 is a circuit to detect a zero crossing of the AC power supply 401, and outputs the ZEROX signal to the CPU 420. The ZEROX signal is used for controlling the heater 300. The CPU 420 detects an edge of the pulse of the ZEROX signal outputted from the zero crossing detecting unit 430, and independently controls the ON/OFF of the triacs 416, 426, and 436 respectively by phase control. The current supplied to the heater 300 of the image forming apparatus of Example 1 is adjusted by the phase angle in one half wave of the AC power supply 401.

Figure 5:
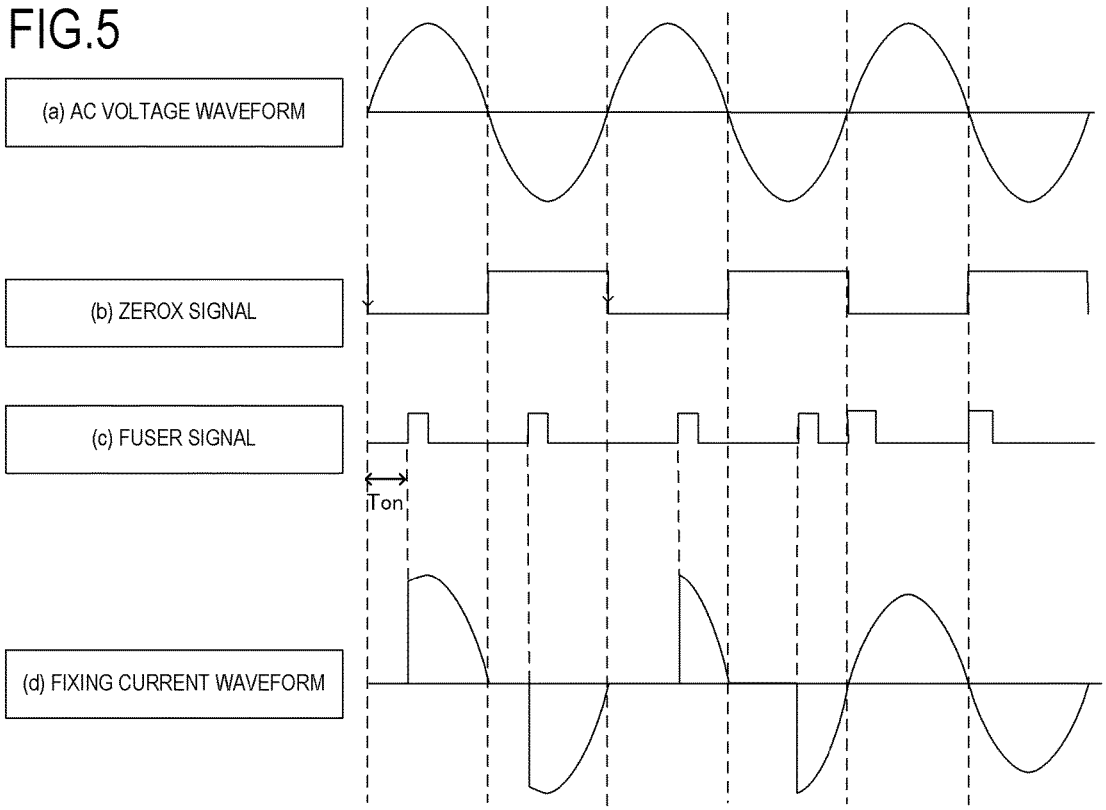
FIG. 5 includes graphs (a) to (d) depicting an overview of the fixing power control.

In FIG. 5, graph (a) shows an AC voltage waveform of the AC power supply 401, and graph (b) shows an output value of the ZEROX signal that the zero crossing detecting unit 430 calculated based on the AC voltage waveform. Graph (c) shows the output value of the heater drive signal (FUSER1 signal, FUSER2 signal, and FUSER3 signal). The heater drive signal becomes a high level after a predetermined time elapses (TON) from the timing when the edge of the pulse of the ZEROX signal is detected and the ZEROX signal falls. Thereby, the fixing current waveform can be controlled, as shown in graph (d). The CPU 420 can control the supply of the current to the first heating block, the second heating block, and the third heating block independently by the independent control of the FUSER1 signal, the FUSER2, signal and the FUSER3 signal, respectively.

FIG. 6 is a table showing the relationship of the timing of the heater drive signal and the current to be supplied to the heater 300 when the frequency of the AC power supply 301 is 50 Hz or 60 Hz. The value of the supply current indicates a current by percentage when the current generated when the heater 300 is turned ON in all phases is 100%. In this case, the power generated in the first heating block is 206 W, the power generated in the second heating block is 1029 W, and the power generated in the third heating block is 206 W. Here, the voltage of the AC power supply 401 is 120 V. The maximum power in Example 1 is the total power when the supply current of the first to third heating blocks is 100%, and is 1440 W. In the image forming apparatus 100 of Example 1, however, the startup power of the fixing is kept to within the power limit $W_{Limit}$ (1296 W), so that the total power consumption of the image forming apparatus 100 as a whole does not exceed the current 15A standard specified by Underwriters Laboratories Inc., of Northbrook, Ill., United States (UL). In Example 1, the power equivalent to the power limit $W_{Limit}$ (1296 W) can be applied to the heater 300 when the current of the first to third blocks is 90%.

Here, the composite resistance of the first to third heating blocks is 10Ω. This means that if the frequency of the AC power supply 401 is 50 Hz and the supply current is 40%, for example, then the heater drive signal is outputted at 5.50 milliseconds (msec) after the fall of the ZEROX signal.

Figure 7:
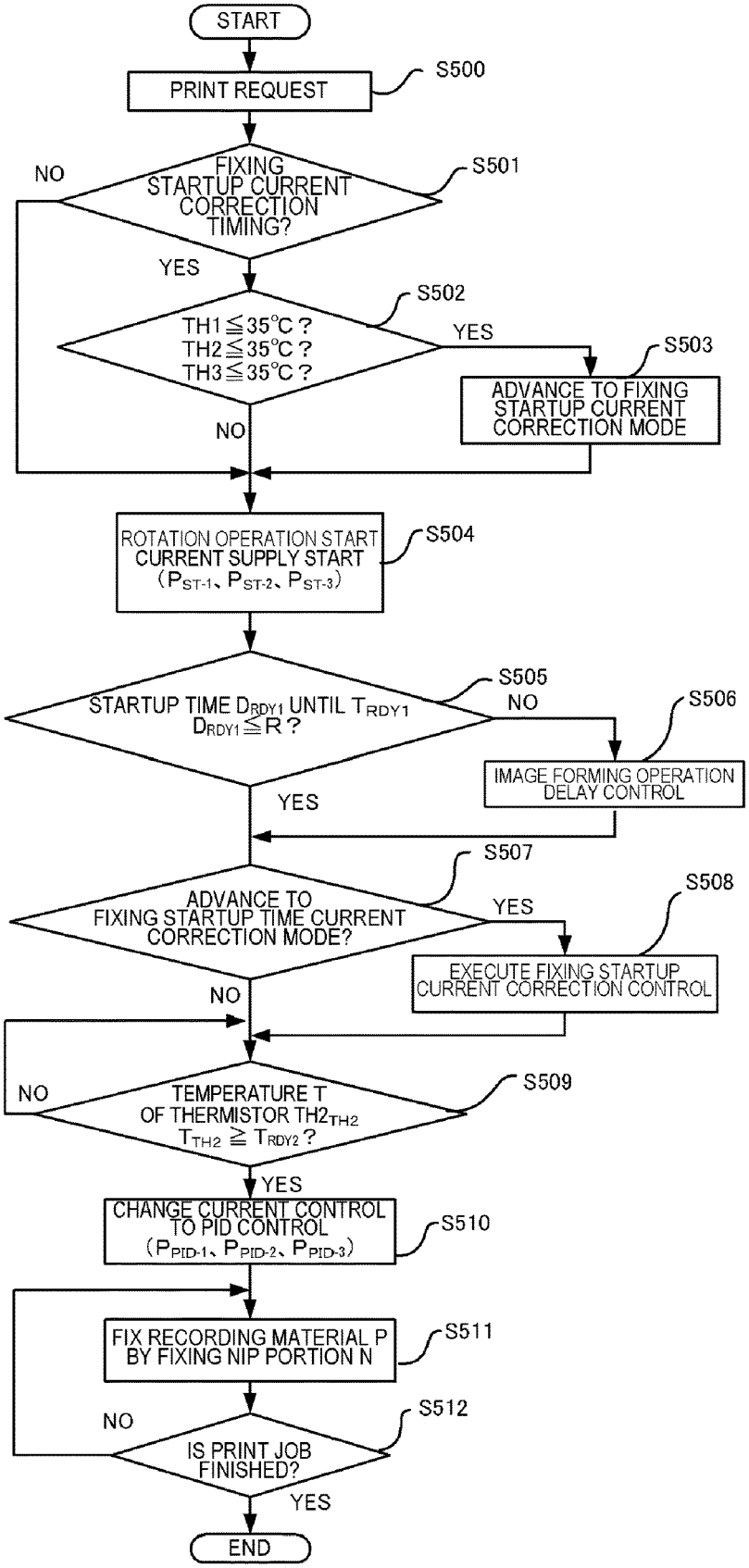
FIG. 7 is a flow chart depicting the control sequence of the fixing apparatus.

FIG. 7 is a flow chart depicting a control sequence of the fixing apparatus 10 by the CPU 420, which functions as the current amount correcting portion.

Figure 8:
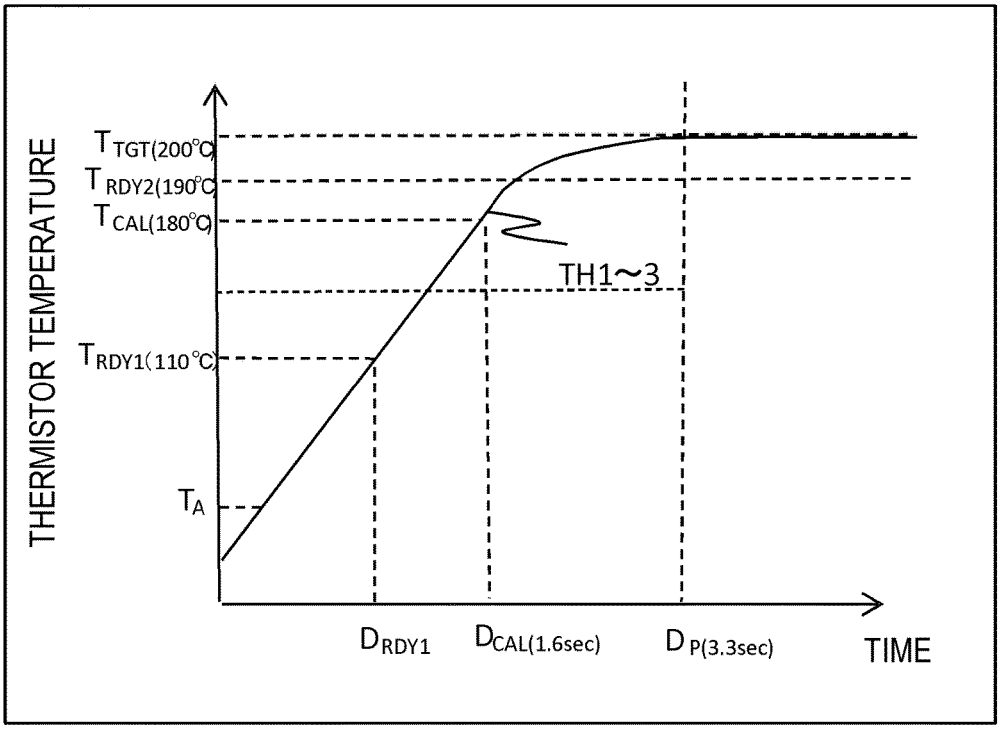
FIG. 8 is a diagram depicting the temperature control state of the fixing apparatus.

FIG. 8 is a diagram depicting a temperature control state of the fixing apparatus 10.

When the image forming apparatus 100 is started (start of control sequence) and a print request is generated in step S500, it is determined in step S501 whether this is a current correction timing when the fixing operation is started. The current correction of the startup of the fixing operation is the correction of the current amount to be supplied to the heat generating resistor for each heating block, so that the difference (variation) of the temperature rise amount per unit time, among each heating block, is minimized by the time when the heater 300 reaches a temperature at which the fixing operation can be performed. The initial variation may be corrected at a timing when the fixing apparatus 10 is new, or a variation caused by age deterioration may be corrected periodically every time several thousand sheets are printed. If it is determined in step S501 that this is the current correction timing at the start of the fixing operation, and if it is determined in step S502 that the initial temperature TA of any of the thermistors TH1 to TH3 is an initial temperature threshold of 35° C. or less, the mode shifts to the fixing startup time of current correction mode in step S503. In Example 1, the current correction is performed at the start of fixing in each heating block only when the initial temperature TA is the initial temperature threshold or less (35° C. or less), whereby variation of the temperature distribution in the longitudinal direction, among each heating block generated depending on the temperature history at paper feeding, can be minimized. As a result, a more stable current correction control can be performed.

In step S504, the fixing apparatus 10 starts a rotating operation at the image forming processing speed of 190 mm/sec, and turns the triacs 416, 426, and 436 ON to start supplying power to the first, second and third heating blocks. In this case, $P_{ST\text{-}1}$, $P_{ST\text{-}2}$, and $P_{ST\text{-}3}$, which are the supply currents (%) to the first, second, and third heating blocks at the start of the fixing operation, respectively, are supplied. At this time, the target temperature TTGT of each heating block is 200° C. $P_{ST\text{-}1}$, $P_{ST\text{-}2}$, and $P_{ST\text{-}3}$ are the correction values of the supply current determined by the later mentioned calculation in step S508, and are stored in a non-volatile memory (not illustrated). The initial set values of $P_{ST\text{-}1}$, $P_{ST\text{-}2}$, and $P_{ST\text{-}3}$ at the factory prior to shipment are 90%, respectively, which correspond to the supply current (%) to acquire the power limit $W_{Limit}$ (1296 W) at the start of the fixing operation, as mentioned above.

In step S505, when the thermistor TH2 reaches $T_{RDY1}$, it is determined whether the startup time $D_{RDY1}$, from the heater power supply ON to $T_{RDY1}$ (S502 to S505), is a reference time R or less.

If $D_{RDY1} \leq R$, the image forming apparatus 100 starts the image forming operation. In other words, the image forming apparatus 100 starts the latent image forming process, the development process, and the transfer process operations, forming an unfixed toner image on the recording material P.

If $D_{RDY1}$>R, it is determined that the temperature rising speed is slow, and processing moves to the startup extension control in step S506, and after delaying Y seconds, the image forming operation is started.

If the mode shifted to the fixing startup time of current correction mode at the start of fixing in step S503 (S507, YES), the CPU 420 performs the current correction control at the start of the fixing operation in step S508, in accordance with the temperature rising speed at the start of the fixing operation of each heating block.

Here, in the current correction control at the start of the fixing operation, which is the characteristic of Example 1, the variation of the temperature rising speed is acquired by the following arithmetic processing. First, the differences between the temperatures $T_{TH1}$, $T_{TH2}$, and $T_{TH3}$ of the thermistors TH1 to TH3 in the temperature rising reference time $D_{CAL}$ (2.7 sec) during the state of fixing and the temperature rising reference temperature $T_{CAL}$ (180° C.) in the temperature rising reference time $D_{CAL}$ (2.7 sec) are calculated, respectively. In other words, $\Delta T_{TH1}=T_{TH1}-T_{CAL}$, $\Delta T_{TH2}=T_{TH2}-T_{CAL}$, and $\Delta T_{TH3}=T_{TH3}-T_{CAL}$ are determined. Then, the current correction coefficient E ($E_1$, $E_2$, and $E_3$) is determined from these difference values ($\Delta T_{TH1}$, $\Delta T_{TH2}$, and $\Delta T_{TH3}$) based on the temperature difference current correction table in FIG. 9. Here, the temperature rising reference time $D_{CAL}$ is the time during which each of the powers $P_{ST-1}$, $P_{ST-2}$, and $P_{ST-3}$ is supplied to each heating block, respectively. The variation of the temperature rising speed in each heating block can be determined by determining each temperature difference value in the temperature rising reference time $D_{CAL}$ ($\Delta T_{TH1}=T_{TH1}-T_{CAL}$, $\Delta T_{TH2}=T_{TH2}-T_{CAL}$, and $\Delta T_{TH3}=T_{TH3}-T_{CAL}$).

Then, a normalization coefficient Z, to normalize the total power amount of the first, second, and third heating blocks to 1296 W, which is the power limit $W_{Limit}$ value, is determined.

$$Z=(W_1\times E_1+W_2\times E_2+W_3\times E_3)/W_{Limit}$$

The powers $W_1'$, $W_2'$, and $W_3'$ of the first, second, and third heating blocks, after the correction operation, can be determined by Expressions (1) to (3). Here $W_1$, $W_2$, and $W_3$ denote the power amount of each heating block before the correction operation.

$$W_1'=W_1\times(E_1/Z) \quad (1)$$

$$W_2'=W_2\times(E_2/Z) \quad (2)$$

$$W_3'=W_3\times(E_3/Z) \quad (3)$$

In Example 1, the temperature rising curves in the longitudinal direction can be matched by determining the current correction coefficients $E_1$, $E_2$, and $E_3$ of the first, second, and third heating blocks, based on the difference of the temperature rising reference temperature $T_{CAL}$. Further, the total power amount ($W_1'+W_2'+W_3'$) at the start of the fixing operation can be kept to within the power limit $W_{Limit}$ (1296 W) by determining the normalization coefficient Z.

$P_{ST-1}$, $P_{ST-2}$, and $P_{ST-3}$, which are the supply currents (%) to the first, second, and third heating blocks at the start of fixing, are corrected by Expressions (4) to (6).

$$P_{ST-1}'=P_{ST-1}\times E_1/Z \quad (4)$$

$$P_{ST-2}'=P_{ST-2}\times E_2/Z \quad (5)$$

$$P_{ST-3}'=P_{ST-3}\times E_3/Z \quad (6)$$

The corrected current values $P_{ST-1}'$, $P_{ST-2}'$, and $P_{ST-3}'$, after the calculation, are stored in the non-volatile memory (not illustrated), and are used as the current values $P_{ST-1}$, $P_{ST-2}$, and $P_{ST-3}$ at the start of fixing when printing is requested the next time.

When the thermistor TH2 reaches $T_{RDY2}$ (190° C.) in step S509, in step S510, the supply current becomes variable in the 0% to 100% range due to proportional-integral-derivative (PID) control ($P_{PID-1}$, $P_{PID-2}$, $P_{PID-3}$), and the temperature control is performed to be the target temperature TTGT. By switching the supply current from $P_{ST-1}$, $P_{ST-2}$, and $P_{ST-3}$ to $P_{PID-1}$, $P_{PID-2}$, and $P_{PID-3}$, an overshoot after reaching the target temperature $T_{TGT}$ is prevented.

In step S511, the recording material P reaches the fixing apparatus 10, and the operation of the fixing apparatus 10 is continued until the print job of the unfixed toner image on the recording material P ends in the fixing nip portion N (step S512).

An effect of using the current correction control at the start of the fixing operation according to Example 1 will be described with reference to FIGS. 10A and 10B and FIGS. 11A and 11B.

Figure 10A:
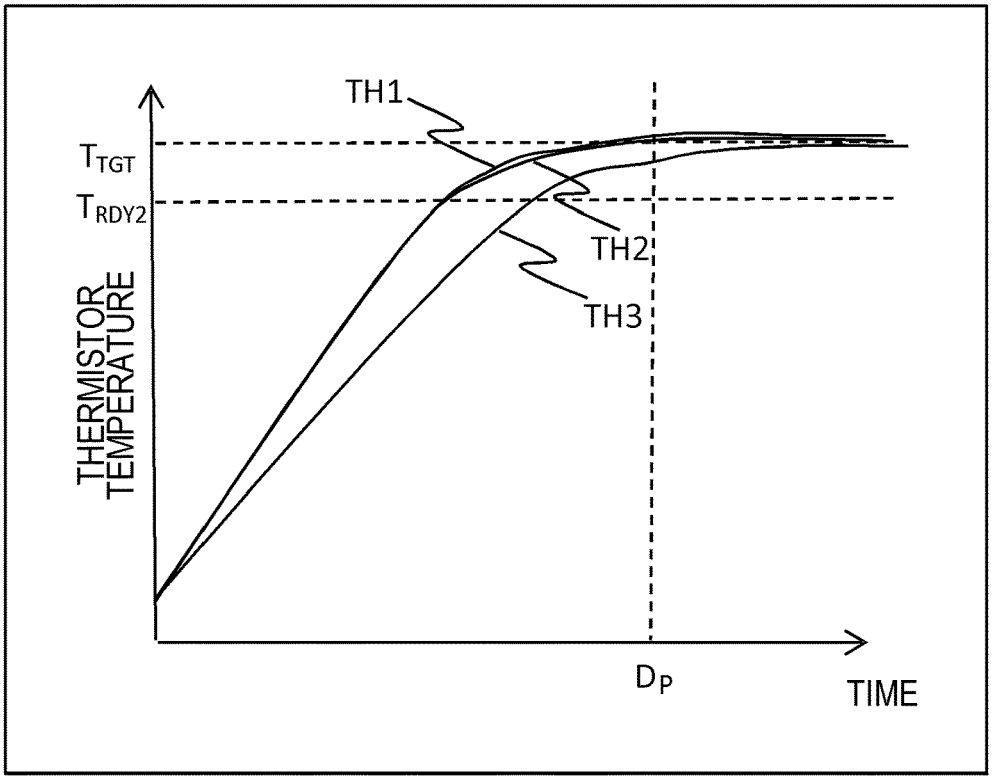
FIGS. 10A and 10B show diagrams depicting the behavior of the thermistors before the current correction processing and the temperature distribution in the longitudinal direction.
Figure 10B:
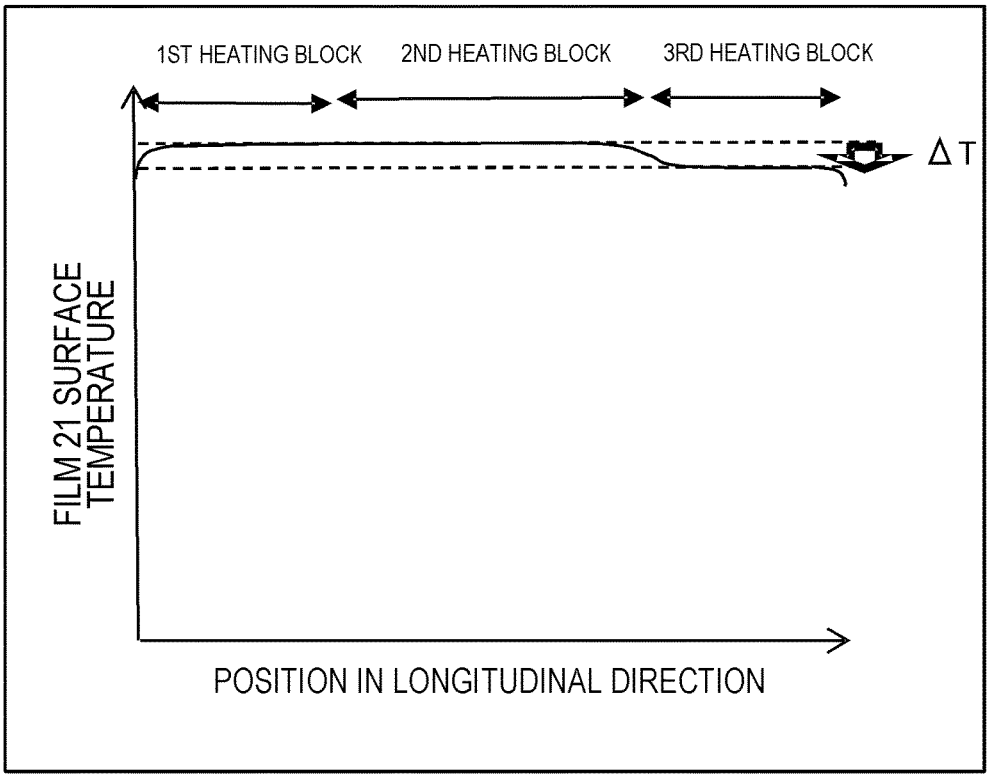

FIGS. 10A and 10B show the behavior of the thermistors TH1 to TH3 at the start of the fixing operation before the current correction processing of Example 1 (FIG. 10A), and the surface temperature distribution of the film 21 in the longitudinal direction at the recording material passing timing $D_P$ (3.3 seconds later) (FIG. 10B). As the supply current values $P_{ST-1}$, $P_{ST-2}$, and $P_{ST-3}$ at the start of the fixing operation in the first, second, and third heating blocks, 90% of the initial set values are input, respectively. In the case of not performing the correction processing, the temperature rising of TH3 becomes slower than that of TH1 and TH2, as shown in FIG. 10A, and, as a result, the temperature becomes lower than TH1 and TH2 by ΔT at the recording material passing timing $D_P$, as shown in FIG. 10B. Possible causes for this are the variation of resistances and variation of the temperature resistance characteristics of the heat generating resistors, the variation of the width of the fixing nip portion N, and the variation of the thermal capacitance of the fixing member and pressure member.

Figure 11A:
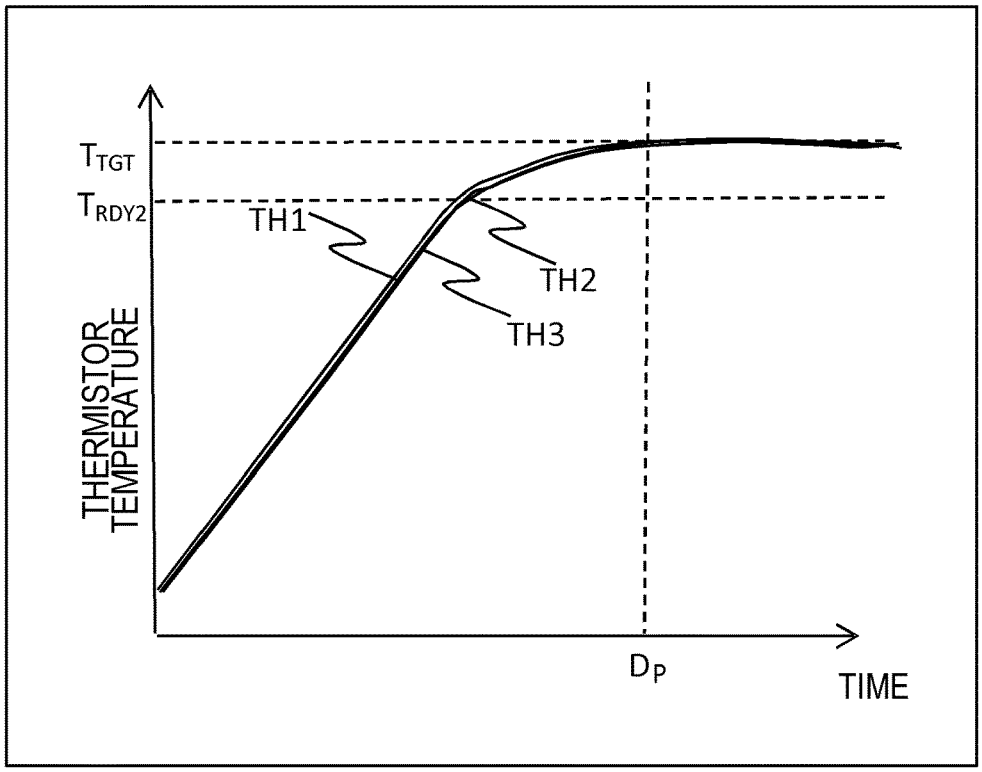
FIGS. 11A and 11B show diagrams depicting the behavior of the thermistors after the current correction processing and the temperature distribution in the longitudinal direction.
Figure 11B:
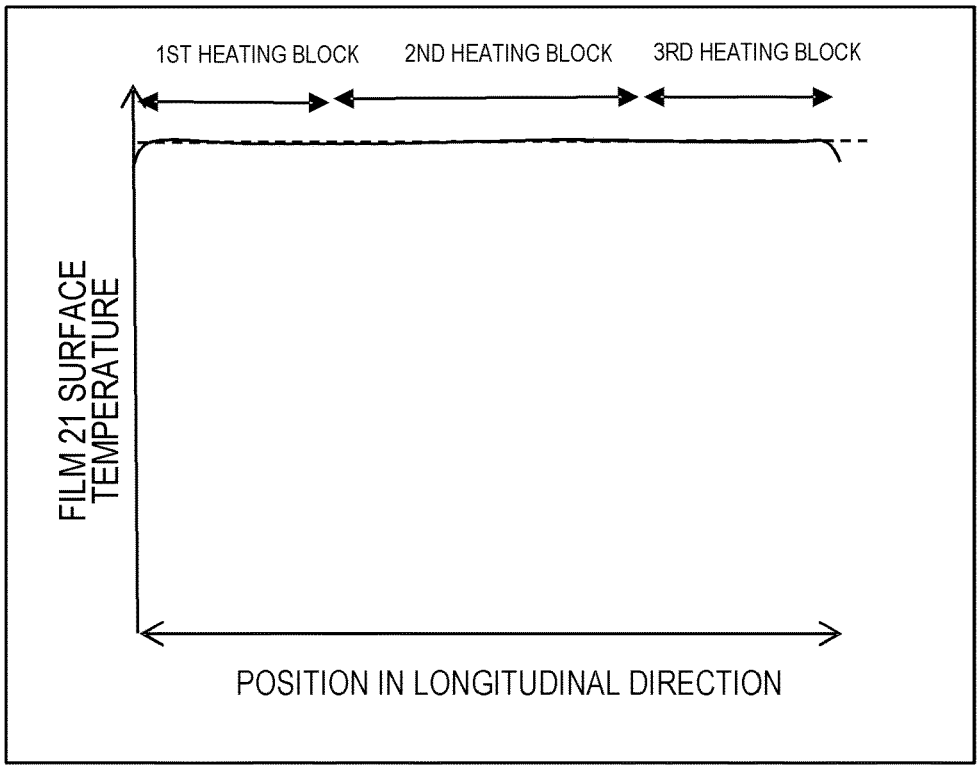

FIGS. 11A and 11B show a result when current correction is performed using a temperature difference current correction table based on the result in FIGS. 10A and 10B. In other words, FIGS. 11A and 11B show the behavior of the thermistors TH1 to TH3 at the start of the fixing operation after the current correction processing of Example 1 (FIG. 11A), and the surface temperature distribution of the film 21 in the longitudinal direction at the recording material passing timing $D_P$ (3.3 seconds later) (FIG. 11B). If supply current is corrected, as shown in FIG. 11A, the recording material passing timing $D_P$ is not delayed (FPOT is not delayed either) compared with the case of not performing correction, and variation of the temperature rising in each heating block can be reduced. Thereby, the surface temperature in the longitudinal direction can be uniform.

Table 1 shows the supply current (%) to each heating block and the temperature of each heating block at the recording material passing timing $D_P$ (3.3 seconds later), before (a) and after (b) executing the current correction control at startup according to Example 1. Because of the current correction control at startup, the supply current to the third heating block, in which temperature rises slowly, is increased, so as to adjust the supply current to the first and second heating blocks, in which temperature rises fast. Then, the temperatures of the first, second, and third heating blocks can rise to the target temperature $T_{TGT}$ (=200° C.) at the recording material passing timing $D_P$ (3.3 second later) without exceeding the power limit $W_{Limit}$.

TABLE 1

| | (a) Before Executing Current Correction Control at Start of Fixing Operation | | | (b) After Executing Current Correction Control at Start of Fixing Operation | | |
|---|---|---|---|---|---|---|
| | 1st Heating Block | 2nd Heating Block | 3rd Heating Block | 1st Heating Block | 2nd Heating Block | 3rd Heating Block |
| Supply Current (%) | 90% | 90% | 90% | 89% | 89% | 94% |
| Thermistor Temperature at Recording Material Passing Timing $D_P$ | 200° C. | 200° C. | 192° C. | 199° C. | 200° C. | 199° C. |
| Film Surface Temperature at Recording Material Passing Timing $D_P$ | 180° C. | 180° C. | 172° C. | 179° C. | 180° C. | 179° C. |
| Time Required to Reach Target Temperature $T_{TGT}$ | 3.0 sec | 3.0 sec | 3.6 sec | 3.2 sec | 3.2 sec | 3.2 sec |

As described above, by performing the current correction control at the start of the fixing operation based on Example 1, variation of temperature rising in the longitudinal direction at the start of the fixing operation can be reduced, and a good fixed image can be acquired while preventing the delay of FPOT.

In Example 1, the heat generating resistor having the PTC characteristic is used, but the combination of the heat generating resistor and the fixing member is not limited to this, and a heat generating resistor of which a TCR value is small or a heat generating resistor having a negative temperature coefficient (NTC) characteristic may be used.

Further, in Example 1, the current correction at the start of the fixing operation is performed when the fixing apparatus 10 starts up during printing, but current correction may be performed at a timing that is not during printing, such as at a timing when the power of the image forming apparatus 100 is turned ON.

Furthermore, in Example 1, the temperature difference current correction table is determined based on the difference of the temperature rise reference temperature $T_{CAL}$ of each heating block during the time $D_{CAL}$, but the present invention is not limited to this. For example, the current correction table may be created based on the relationship of the time difference between the time of each heating block to reach the temperature rising reference temperature $T_{IAL}$ and the reference time $D_{CAL}$.

Modification 1

Figure 12A:
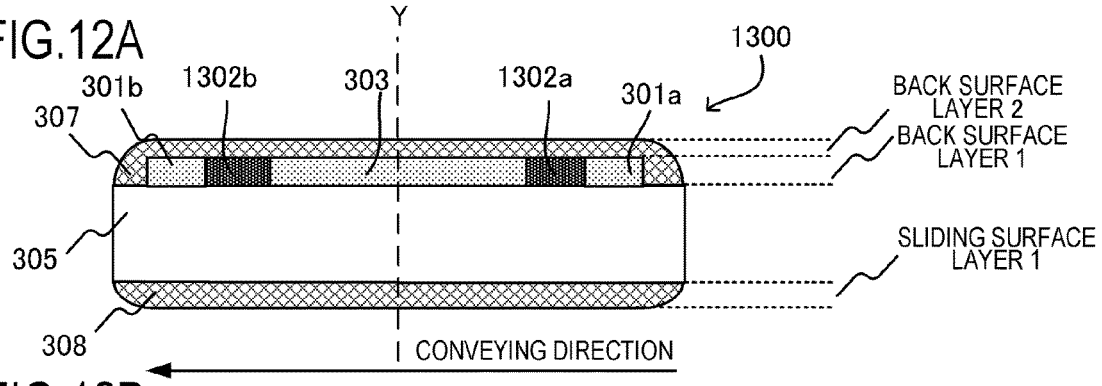
FIGS. 12A and 12B show diagrams depicting a configuration of a heater (Modification 1).
Figure 12B:
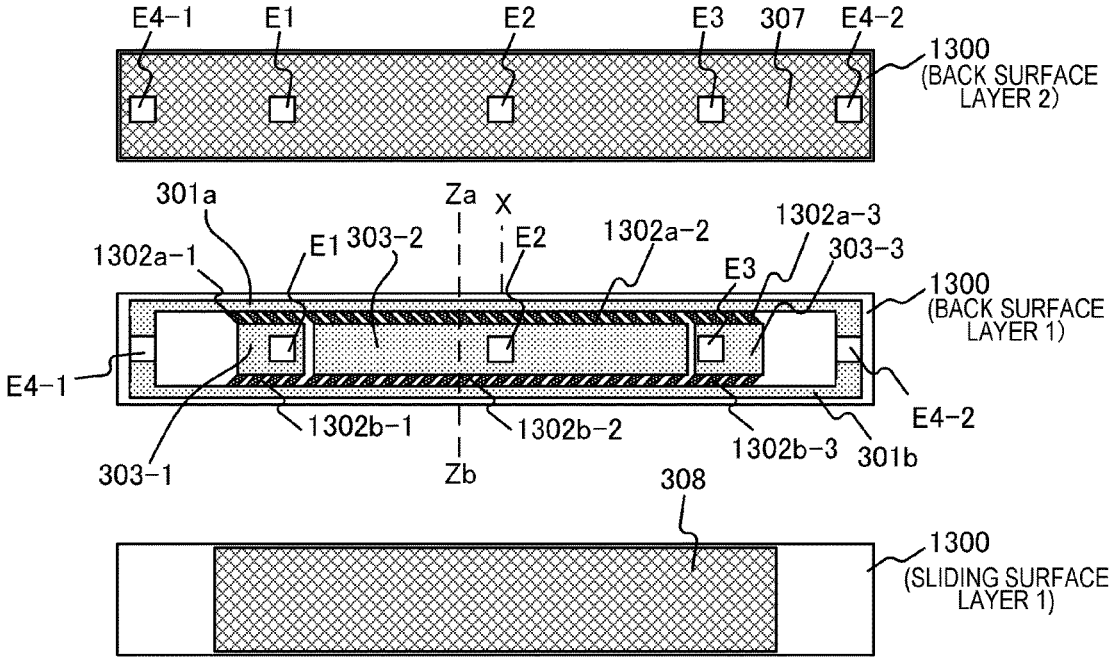

As Modification 1 of Example 1, the present invention may be applied to a configuration depicted in FIGS. 12A and 12B. In other words, a heater 1300 of Modification 1 is constituted by heat generating resistors, which are intermittently formed and connected parallel with the conductor. By decreasing the area of the heat generating resistors like this, a heating amount equivalent to Example 1 can be implemented using a heat generating resistor paste material of which a sheet resistance is lower. Normally, the PTC characteristic of the heat generating resistor paste material is greater as the sheet resistance is lower, and, in the case of detecting temperature using the resistance temperature characteristic of the heat generating resistor, as in Example 1, the detection accuracy can be greater as the absolute value of the TCR value is greater. Further, if each heat generating resistor 1302*a*-1, 1302*a*-2, 1302*a*-3, 1302*b*-1, 1302*b*-2, and 1302*b*-3 connected in parallel is formed diagonally with respect to the lateral direction, the heating amount of each heat generating resistor in the longitudinal direction can be uniform. Considering the sheet resistance value of the heat generating resistor to be used, a better configuration from among Examples and Modifications including this modification may be selected. A composing element of Modification 1 that is the same as Example 1 is denoted with the same reference sign, and a description thereof is omitted.

Modification 2

Figure 13A:
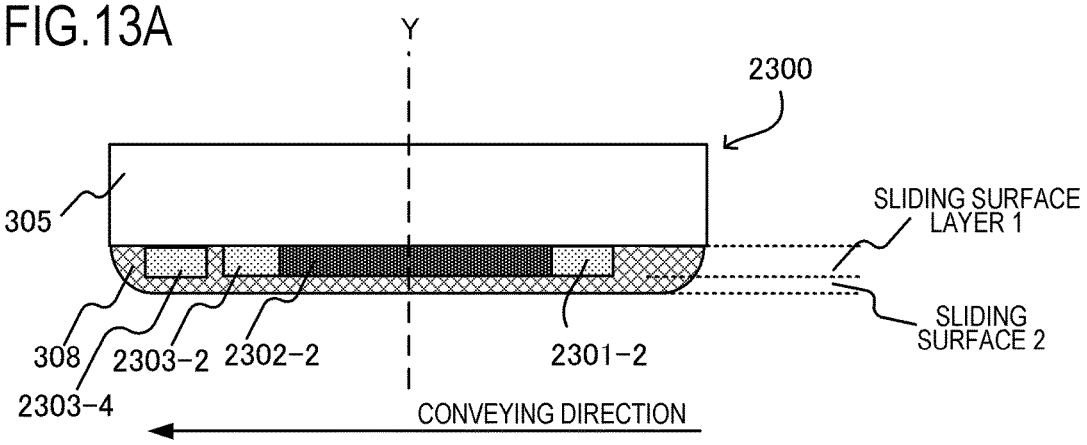
FIGS. 13A and 13B show diagrams depicting a configuration of a heater (Modification 2).
Figure 13B:
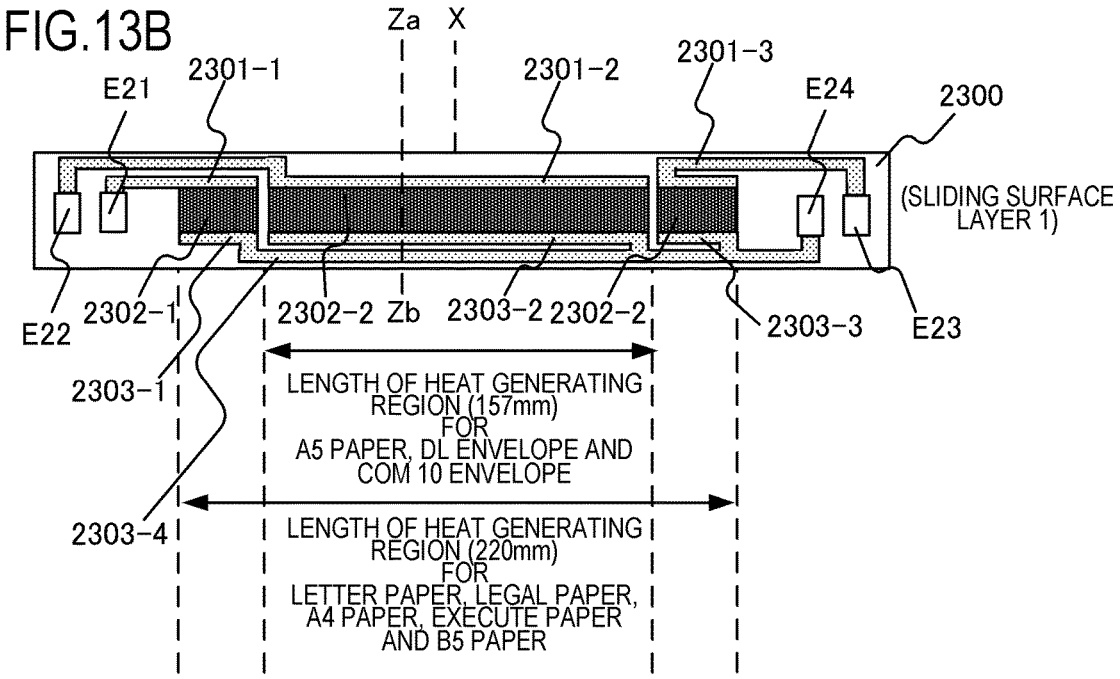

As Modification 2 of Example 1, the present invention may be applied to a configuration depicted in FIGS. 13A and 13B. In other words, a heater 2300 of Modification 2 is constituted by disposing a heat generating resistor 2302, conductors 2301 and 2303, and electrodes $E_{21}$ to $E_{24}$ on the sliding surface side (sliding surface layer 1) of the film 21. The conductor 2303, which is the second conductor, and conductors 2303-1, 2303-2, and 2303-3 connected to each heat generating resistor, are interconnected in the conductor 2303-4. By using the configuration of Modification 2, heat generated in each heat generating resistor 2302-1, 2302-2, and 2302-3 can be transferred to the film 21 at a higher speed. This means that the image heating apparatus can be heated more quickly, and the first print out time (FPOT) can be decreased. On the other hand, the heater substrate may become larger since the conductors 2301-1, 2301-2, 2301-3, 2303-1, 2303-2, 2303-3, and 2303-4, and the electrodes $E_{21}$, $E_{22}$, $E_{23}$, and $E_{24}$ must be disposed on the sliding surface side. Considering the limitations of the printer main body size and the required performance of the FPOT, and the like, a better configuration from among Examples and Modifications including this modification may be selected. A composing element of Modification 2 that is the same as Example 1 is denoted with the same reference sign, and a description thereof is omitted.

Modification 3

As Modification 3 of Example 1, the present invention may be applied to a configuration depicted in FIG. 14. In Example 1, power is supplied to the heat generating resistors in the conveying direction, but in Modification 3, power is supplied to the heat generating resistors in the longitudinal direction. Further, the heat generating resistors having the PTC characteristic are used in Example 1, but heat generating resistors 3302-1, 3302-2, and 3302-3 having the negative temperature coefficient (NTC) characteristic are used in Modification 3. A first conductor 3301-1 is connected to one end of the heat generating resistor 3302-1 in the longitudinal direction, and a second conductor 3303 is connected to the other end thereof. In the same manner, a first conductor 3301-2 is connected to one end of the heat generating resistor 3302-2 in the longitudinal direction, and the second conductor 3303 is connected to the other end thereof.

Figure 14A:
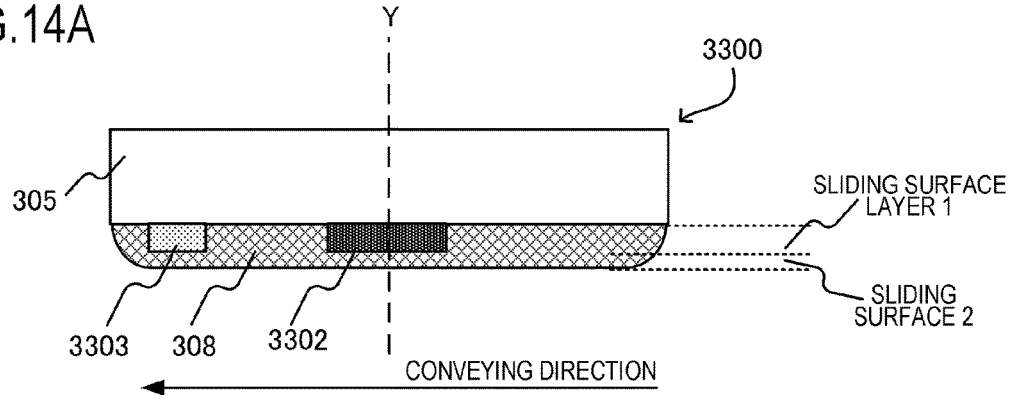
FIGS. 14A and 14B show diagrams depicting a configuration of a heater (Modification 3).
Figure 14B:
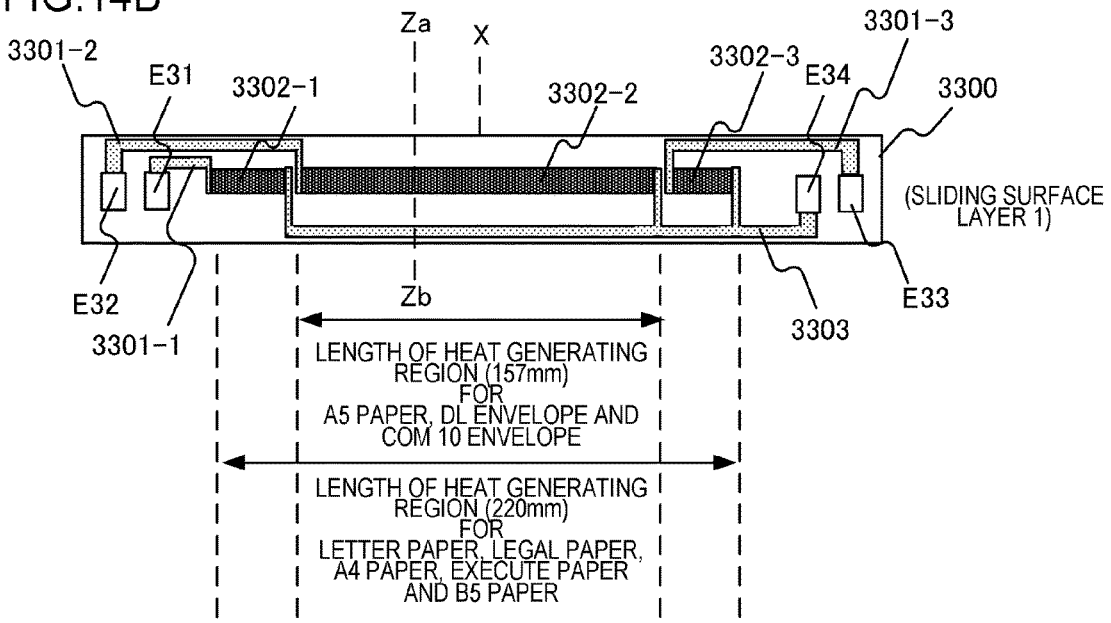

Further, a first conductor 3301-3 is connected to one end of the heat generating resistor 3302-3 in the longitudinal direction, and the second conductor 3303 is connected to the other end thereof. By using the configuration to supply the power to the heat generating resistors having the NTC (negative temperature resistance characteristic) in the longitudinal direction, the same effect as using the configuration to supply power to the heat generating resistors having the PTC characteristic in the conveying direction can be acquired. In other words, in the case of the NTC characteristic, the resistance decreases in an area of which temperature rises, and, hence, if power is supplied in the longitudinal direction, the heating amount in this area becomes lower than the other areas, and the temperature rise can be reduced. Further, temperature can be detected from the resistance value of the heat generating resistor, as shown in FIGS. 14A and 14B, even if the NTC characteristic of the heat generating resistor is used. Considering the temperature resistance characteristic (TCR) of the heat generating resistor to be used, a better configuration from among Examples and Modifications including this modification may be selected. A composing element of Modification 3 that is the same as Example 1 is denoted with the same reference sign, and a description thereof is omitted.

Modification 4

Figure 15A:
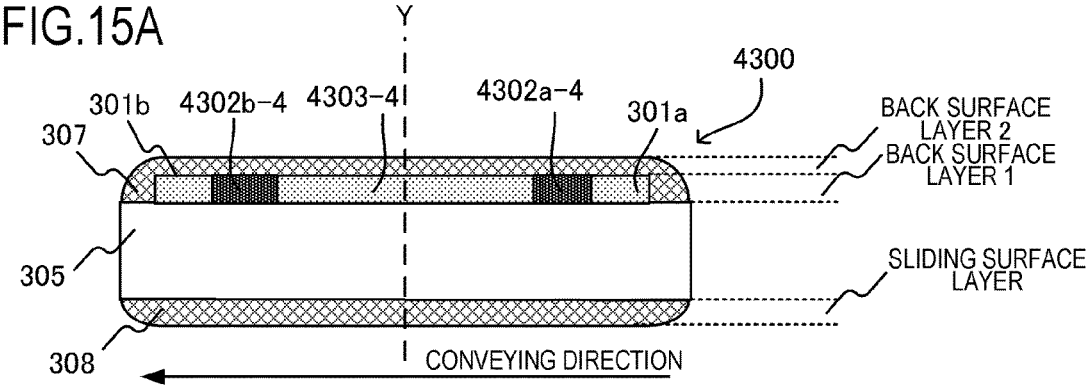
FIGS. 15A and 15B show diagrams depicting a configuration of a heater (Modification 4).
Figure 15B:
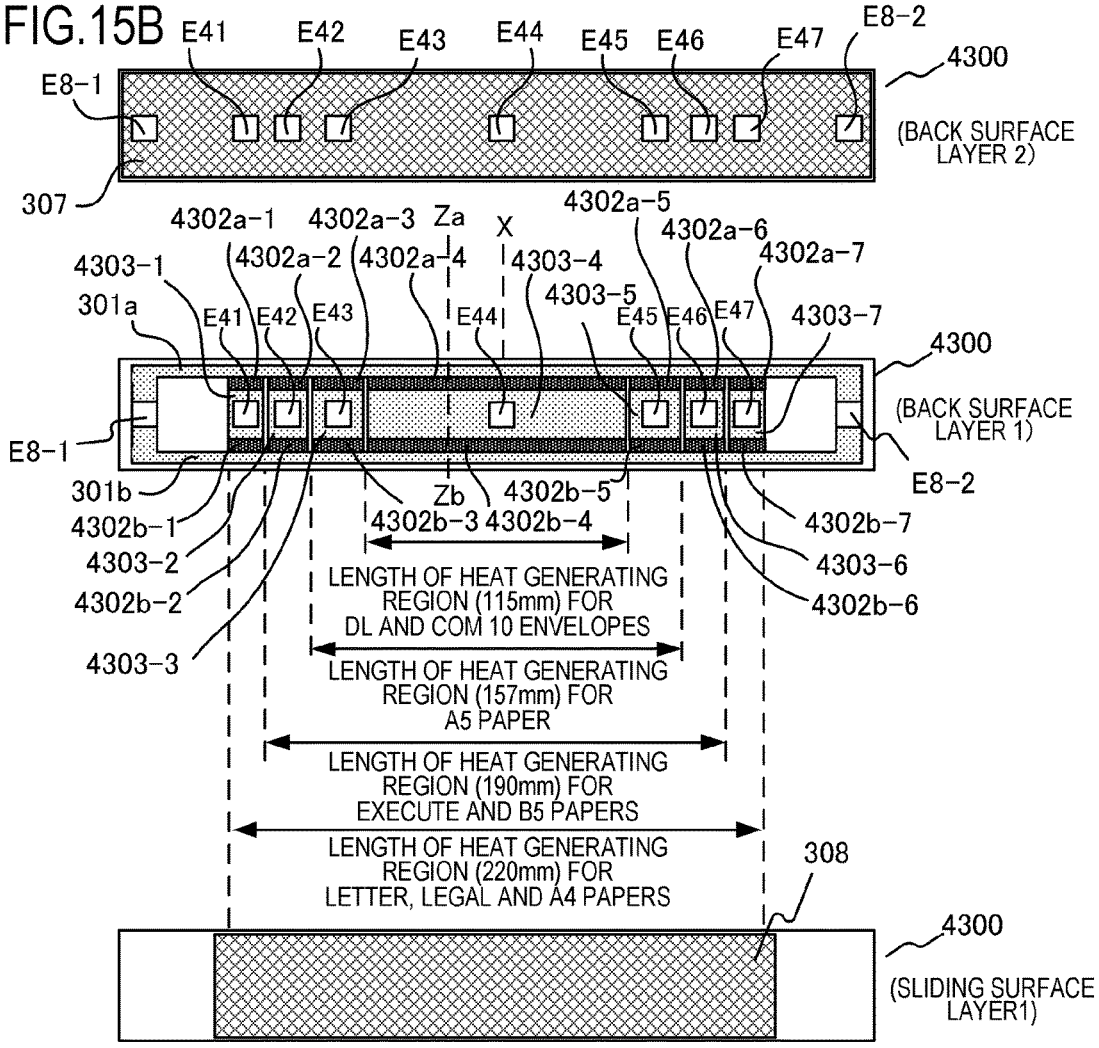

As Modification 4 of Example 1, the present invention may be applied to a configuration depicted in FIGS. 15A and 15B, in which a number of heating blocks that can be independently controlled is increased. In other words, seven heating blocks are constituted of the first conductors 301*a* and 301*b*, the upstream side heat generating resistors 4302*a*-1 to 4302*a*-7, the downstream side heat generating resistors 4302*b*-1 to 4302*b*-7, and the second conductors 4303-1 to 4303-7. The electrodes $E_{41}$ to 47, $E_8$-1, and $E_8$-2 are disposed corresponding to each heating block. Since more heating blocks are disposed, selective power supply control to the paper passing portion can be performed more accurately, and the temperature rising in the non-paper passing portion can be suppressed even more depending on the paper size. Further, if more heating blocks are disposed when the temperature detection is performed using the temperature resistance characteristic of the heat generating resistors, the range of each heating block in the longitudinal direction can be shorter, and the local temperature rise can be detected more accurately. Considering the paper size to be used, the limitations of the configuration of the image heating apparatus and cost, a better configuration from among Examples and Modifications including this modification may be selected. A composing element of Modification 4 that is the same as Example 1 is denoted with the same reference sign, and a description thereof is omitted.

Modification 5

Figure 16:
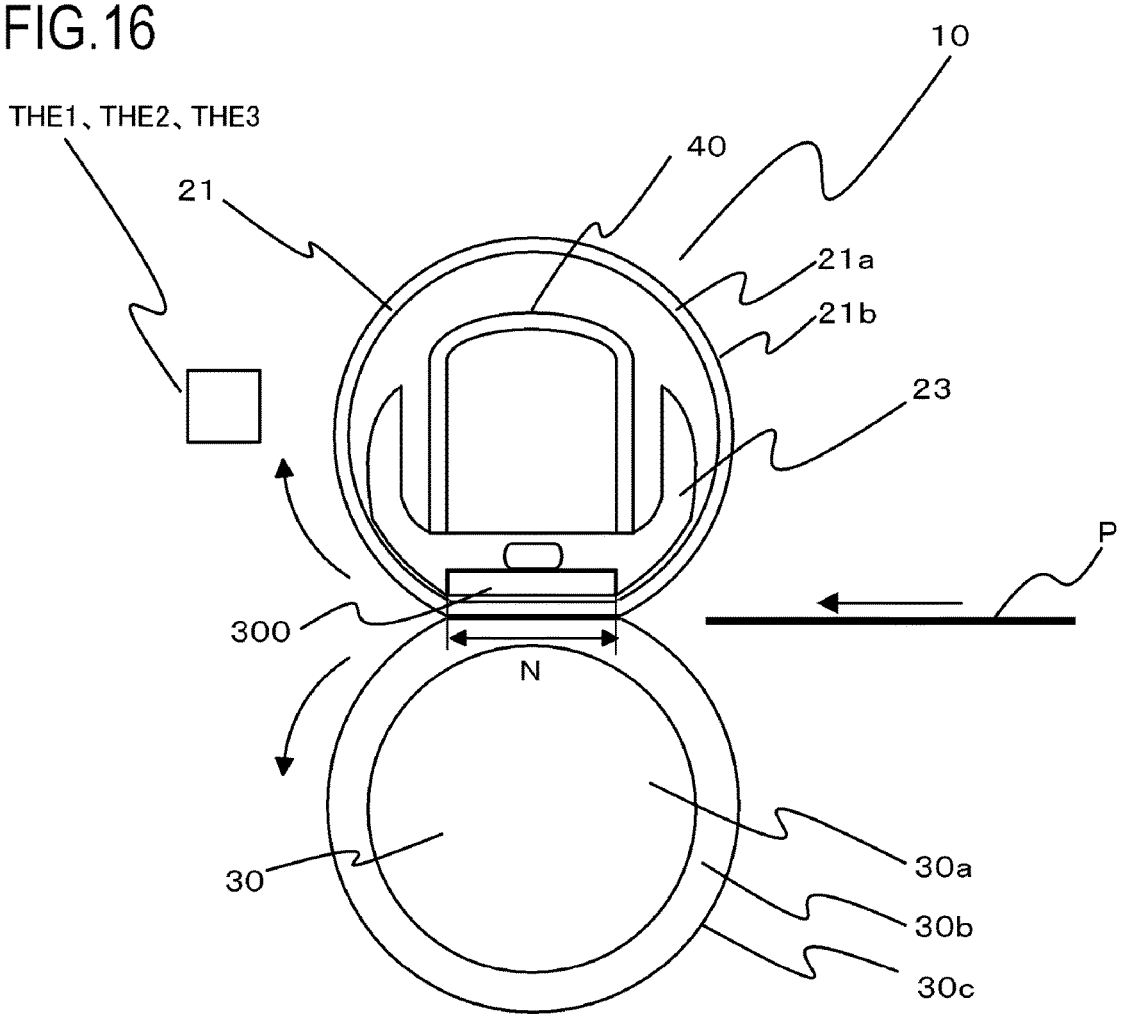
FIG. 16 shows diagrams depicting a configuration of a heating apparatus (Modification 5).

As Modification 5 of Example 1, the present invention may be applied to a configuration depicted in FIG. 16. In other words, the thermistors THE1 to THE3, which are the temperature detecting units, are disposed on the front surface side of the film 21 without contact (positions to face the outer surface of the film 21). In this case, the thermistors THE1 to THE3 are preferably thermopiles that detect radiant heat. By this configuration, the temperature in the longitudinal direction can be more accurately controlled than detecting the temperature of the heater 300, since the temperature of the film 21 that contacts the recording material P can be detected. Considering the limitations of the printer main body size and the required performance of FPOT, and the like, a better configuration from among Examples and Modifications including this modification may be selected. A composing element of Modification 5 that is the same as Example 1 is denoted with the same reference sign, and a description thereof is omitted.

Modification 6

As Modification 6 of Example 1, in the factory manufacturing line of the image heating apparatus, for example, power may be supplied to the heater of the image heating apparatus, and the current correction value may be stored in the memory of the image heating apparatus. In this case, when the image heating apparatus is installed in the image forming apparatus main body, the reading device of the image forming apparatus main body reads the current correction value from this memory. By performing the processing to set the correction amount when the image heating apparatus is manufactured, the current correction value can be determined under more stable conditions in the factory manufacturing line. Considering the limitations of the factory manufacturing line, the image heating apparatus and the image forming apparatus, a better configuration from among Examples and Modifications including this modification may be selected. A composing element of Modification 6 that is the same as Example 1 is denoted with the same reference sign, and a description thereof is omitted.

Modification 7

Figure 17:
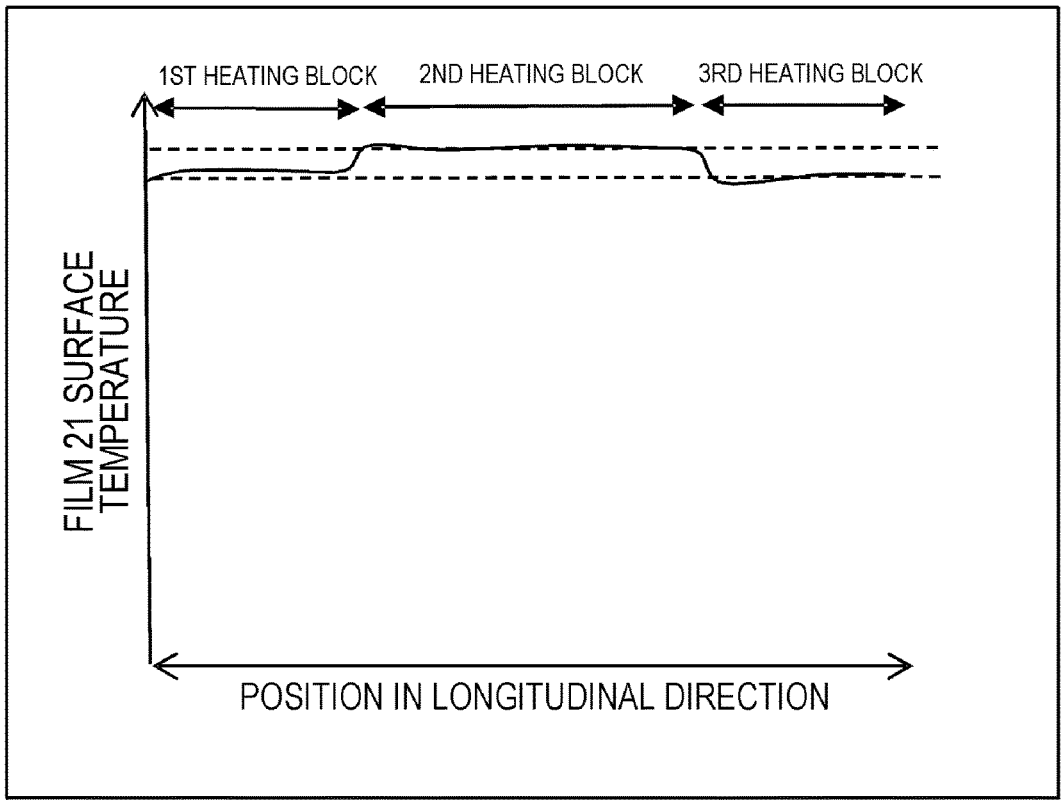
FIG. 17 shows an example of the temperature control in the longitudinal direction.

In Example 1, the current in the longitudinal direction is corrected so that fixing can be started with the temperature distribution that is uniform in the longitudinal direction, but the correction method is not limited to this. As Modification 7 of Example 1, when the width of the recording material P in the longitudinal direction is narrow (e.g. A5 size), as shown in FIG. 17, the target temperature $T_{TGT}$ of the first and third heating blocks may be set low after the current correction is performed, so that the film surface temperature of the first and third heating blocks are decreased. Thereby, the power consumption of the image heating apparatus can be reduced. Considering the fixing performance at the edges in the longitudinal direction, a better configuration from among Examples and Modifications including this modification may be selected. A composing element of Modification 7 that is the same as Example 1 is denoted with the same reference sign, and a description thereof is omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

an image heater constituted of a substrate and a plurality of resistors disposed on the substrate in a longitudinal direction of the substrate, and configured to heat an image, formed on a recording material, during an image heating operation using heat of the heater;

a power supply control circuit configured to control power supplied to the plurality of resistors so as to selectively heat a plurality of heating regions corresponding to the plurality of resistors, respectively;

a plurality of thermistors configured to detect a temperature of each of a plurality of regions of the image heater corresponding to the plurality of heating regions;

a memory that stores instructions; and a processor circuit configured to execute the instructions to function as a current amount correcting portion configured to correct an amount of current that the power supply control circuit supplies to the plurality of resistors, wherein the current amount correcting portion corrects the current amount based on the temperature detected by each of the plurality of thermistors, so that a difference of a temperature rising amount per unit time among the plurality of heating regions at the start of the image heating operation becomes small and a total amount of power supplied to the plurality of resistors is kept to within a predetermined limited power amount.

2. The image heating apparatus according to claim 1, wherein the current amount correcting portion acquires respective temperature rising rates of the plurality of heating regions based on the temperature detected by each of the plurality of thermistors, and corrects the current amount in accordance with the acquired temperature rising rates in addition to the temperature detected by the thermistors, for each of the plurality of heating regions.

3. The image heating apparatus according to claim 2, wherein the current amount correcting portion corrects the current amount for each of the plurality of heating regions by a correction amount that is set in advance in accordance with the acquired temperature rising rate.

4. The image heating apparatus according to claim 3, wherein, during manufacture of the image heating apparatus, power is supplied to the heater and the current amount correcting portion acquires respective temperature rising rates of the plurality of heating regions, to set the correction amount that is set in advance.

5. The image heating apparatus according to claim 1, wherein each of the plurality of heat generating resistors has one of a positive temperature resistance characteristic and a negative temperature resistance characteristic.

6. The image heating apparatus according to claim 1, further comprising a cylindrical film that rotates, with an inner surface thereof being in contact with the heater, wherein the image, formed on the recording material, is heated via the film.

7. The image heating apparatus according to claim 6, wherein each of the plurality of thermistors includes a temperature detecting element disposed on an opposite side of the heater relative to a side of the heater contacting the inner surface of the film.

8. The image heating apparatus according to claim 6, wherein each of the plurality of thermistors includes a temperature detecting element disposed in a position facing an outer surface of the film.

9. An image forming apparatus comprising:

(A) an image forming unit configured to form an image on a recording material; and (B) a fixing portion configured to fix the image, formed on the recording material, onto the recording material, wherein the fixing portion includes:

(a) an image heater constituted of a substrate and a plurality of resistors disposed on the substrate in a longitudinal direction of the substrate, and configured to heat the image, formed on the recording material, during an image heating operation using heat of the heater;

(b) a power supply control circuit configured to control power to be supplied to the plurality of resistors so as to selectively heat a plurality of heating regions corresponding to the plurality of resistors, respectively;

(c) a plurality of thermistors configured to detect a temperature of each of a plurality of regions of the image heater corresponding to the plurality of heating regions;

(d) a memory that stores instructions; and (e) a processor circuit configured to execute the instructions to function as a current amount correcting portion configured to correct an amount of current that the power supply control circuit supplies to the plurality of resistors, wherein the current amount correcting portion corrects the current amount based on the temperature detected by each of the plurality of thermistors, so that a difference of a temperature rising amount per unit time among the plurality of heating regions at the start of the image heating operation becomes small and a total amount of power supplied to the plurality of resistors is kept within a predetermined limited power amount.

10. The image forming apparatus according to claim 9, wherein each of the plurality of heat generating resistors has one of a positive temperature resistance characteristic and a negative temperature resistance characteristic.

11. The image forming apparatus according to claim 9, the current amount correcting portion acquires respective temperature rising rates of the plurality of heating regions based on the temperature detected by each of the plurality of thermistors, and corrects the current amount in accordance with the acquired temperature rising rates in addition to the temperature detected by the thermistors for each of the plurality of heating regions.

12. The image forming apparatus according to claim 11, wherein the current amount correcting portion corrects the current amount for each of the plurality of heating regions by a correction amount that is set in advance in accordance with the acquired temperature rising rate.

13. The image forming apparatus according to claim 12, wherein, during manufacture of the image forming apparatus, power is supplied to the heater and the current amount correcting portion acquires respective temperature rising rates of the plurality of heating regions, to set the correction amount that is set in advance.

14. The image forming apparatus according to claim 9, wherein the fixing portion further comprises a cylindrical film that rotates, with an inner surface thereof being in contact with the heater, and wherein the image, formed on the recording material, is heated via the film.

15. The image forming apparatus according to claim 14, wherein each of the plurality of thermistors includes a temperature detecting element disposed on an opposite side of the heater relative to a side of the heater contacting the inner surface of the film.

16. The image forming apparatus according to claim 14, wherein each of the plurality of thermistors includes a temperature detecting element disposed in a position facing an outer surface of the film.

* * * * *